US010258213B2

(12) United States Patent
Lutz et al.

(10) Patent No.: US 10,258,213 B2
(45) Date of Patent: Apr. 16, 2019

(54) BALANCED AIRFLOW FOR A VACUUM ACCESSORY

(71) Applicant: Emerson Electric Co., St. Louis, MO (US)

(72) Inventors: Christopher Lutz, Wentzville, MO (US); Matthew A. Williams, Bridgeton, MO (US); Jamie Swindall, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 68 days.

(21) Appl. No.: 15/379,585

(22) Filed: Dec. 15, 2016

(65) Prior Publication Data

US 2018/0125317 A1 May 10, 2018

Related U.S. Application Data

(60) Continuation-in-part of application No. 15/146,357, filed on May 4, 2016, which is a continuation-in-part of application No. 14/833,326, filed on Aug. 24, 2015, now Pat. No. 9,545,182, which is a division of application No. 14/509,411, filed on Oct. 8, 2014, now Pat. No. 9,241,603.

(60) Provisional application No. 62/156,521, filed on May 4, 2015.

(51) Int. Cl.

| | |
|---|---|
| ***A47L 9/24*** | (2006.01) |
| ***A47L 9/02*** | (2006.01) |
| ***A47L 9/06*** | (2006.01) |

(52) U.S. Cl.

CPC ..... *A47L 9/242* (2013.01); *A47L 9/02* (2013.01); *A47L 9/0686* (2013.01)

(58) Field of Classification Search

CPC ..... A47L 9/242; A47L 9/02; A47L 9/24

See application file for complete search history.

(56) References Cited

U.S. PATENT DOCUMENTS

| | | | | |
|---|---|---|---|---|
| 2,074,042 | A | 3/1937 | Bank | |
| 2,283,428 | A | 5/1942 | Ellis | |
| 3,360,816 | A | 1/1968 | Fontecchio | |
| 3,778,860 | A | 12/1973 | Thielen | |
| 4,625,998 | A | 12/1986 | Draudt et al. | |
| 4,700,429 | A | 10/1987 | Martin et al. | |
| 4,779,385 | A * | 10/1988 | Reiter | B24B 55/10 451/354 |

(Continued)

FOREIGN PATENT DOCUMENTS

| | | |
|---|---|---|
| EP | 0 351 224 | 1/1990 |
| EP | 1 608 253 | 3/2011 |

(Continued)

OTHER PUBLICATIONS

"Dust-Away Hard Floor Attachment", Shark Navigator Lift-Away, [retrieved from the Internet on Jan. 25, 2012 using <URL: http://www.navigatorclean.com/barefloorcleaning.shtml>.].

*Primary Examiner* — Dung Van Nguyen

(74) *Attorney, Agent, or Firm* — Armstrong Teasdale LLP

(57) ABSTRACT

A vacuum accessory having an elongated axis, the accessory comprising an adapter configured to provide fluid communication with a vacuum appliance, at least first and second air outlet ports spaced along the elongated axis of the accessory. The ports are configured to balance airflow along the elongated axis of the accessory.

23 Claims, 28 Drawing Sheets

(56) References Cited

U.S. PATENT DOCUMENTS

| | | | | |
|---|---|---|---|---|
| 4,819,293 | A | 4/1989 | Nicholson | |
| 5,007,206 | A * | 4/1991 | Paterson | B24B 55/105 451/344 |
| 5,113,547 | A | 5/1992 | Mayhew | |
| 5,123,141 | A * | 6/1992 | Erickson | A47L 9/02 15/373 |
| 5,283,988 | A * | 2/1994 | Brown | B24D 15/04 451/344 |
| 5,551,115 | A | 9/1996 | Newville | |
| D406,420 | S | 3/1999 | Sin | |
| 5,876,141 | A | 3/1999 | Hsu | |
| 5,881,430 | A | 3/1999 | Driessen et al. | |
| 5,970,577 | A | 10/1999 | Kim | |
| 5,987,700 | A | 11/1999 | Edlund | |
| D420,774 | S | 2/2000 | Schupp | |
| 6,052,866 | A | 4/2000 | Tuvin et al. | |
| 6,065,183 | A | 5/2000 | Hammeken et al. | |
| 6,125,502 | A | 10/2000 | Hammeken et al. | |
| 6,345,408 | B1 | 2/2002 | Nagai et al. | |
| 6,363,571 | B1 | 4/2002 | Block et al. | |
| 6,478,342 | B1 | 11/2002 | Berfield | |
| 6,519,810 | B2 | 2/2003 | Kim | |
| 6,532,622 | B2 | 3/2003 | Seon et al. | |
| 6,581,974 | B1 | 6/2003 | Ragner et al. | |
| 6,651,290 | B2 | 11/2003 | Kingry et al. | |
| 6,745,434 | B2 | 6/2004 | Smith et al. | |
| 6,889,917 | B2 | 5/2005 | Fahy et al. | |
| 6,904,640 | B2 | 6/2005 | Jin et al. | |
| 7,150,068 | B1 | 12/2006 | Ragner | |
| D548,911 | S | 8/2007 | Main et al. | |
| 7,293,322 | B2 | 11/2007 | Matousek et al. | |
| 7,343,638 | B2 | 3/2008 | Mitchell | |
| 7,350,257 | B2 | 4/2008 | McKay | |
| 7,353,564 | B2 | 4/2008 | Wertz | |
| 7,374,595 | B2 | 5/2008 | Gierer | |
| 7,490,383 | B1 | 2/2009 | Dean | |
| 7,565,715 | B2 | 7/2009 | Harper | |
| 7,743,456 | B2 | 6/2010 | McDonnell | |
| 7,827,649 | B2 | 11/2010 | Horian | |
| 7,850,386 | B2 | 12/2010 | Bensussan | |
| 8,348,726 | B2 * | 1/2013 | Brunner | B24B 55/10 451/354 |
| 8,499,406 | B2 | 8/2013 | Fava | |
| 8,544,145 | B2 | 10/2013 | Arthey et al. | |
| 8,549,690 | B2 | 10/2013 | Vasilakes et al. | |
| 9,073,614 | B2 * | 7/2015 | Kauffman | B63B 59/08 |
| 9,113,763 | B2 | 8/2015 | Porter | |
| 2003/0171051 | A1 | 9/2003 | Bergsten et al. | |
| 2004/0025271 | A1 | 2/2004 | Shimada et al. | |
| 2005/0060827 | A1 | 3/2005 | James | |
| 2006/0000054 | A1 * | 1/2006 | Lim | A47L 9/02 15/415.1 |
| 2007/0136967 | A1 | 6/2007 | Tochacek et al. | |
| 2008/0022488 | A1 | 1/2008 | Dant et al. | |
| 2009/0158551 | A1 | 6/2009 | Varichon et al. | |
| 2011/0016657 | A1 | 1/2011 | Chudleigh | |
| 2013/0174372 | A1 | 7/2013 | Guder et al. | |
| 2013/0174374 | A1 | 7/2013 | Guder et al. | |

FOREIGN PATENT DOCUMENTS

| | | |
|---|---|---|
| GB | 2 415 610 | 5/2006 |
| JP | 03-111016 | 5/1991 |
| WO | 2004/082449 | 9/2004 |
| WO | 2011/092484 | 8/2011 |

* cited by examiner

BALANCED AIRFLOW FOR A VACUUM ACCESSORY

CROSS REFERENCE TO RELATED APPLICATIONS

This application is a continuation-in-part application of, and claims priority to, U.S. application Ser. No. 15/146,357, entitled "Swivel Assembly for a Vacuum Accessory", filed May 4, 2016, which is a non-provisional application of, and claims priority to, U.S. Application Ser. No. 62/156,521, entitled "Swivel Assembly for Connecting a Wand to a Vacuum Accessory and Associated Accessory Tool for Use on Hard Surfaces", filed May 4, 2015. This application is also a continuation-in-part application of, and claims priority to, U.S. application Ser. No. 14/833,326, entitled "Swivel Assembly for Connecting a Wand to a Vacuum Accessory and Associated Accessory Tool for Use on Hard Surfaces", filed Aug. 24, 2015, which is a divisional of, U.S. application Ser. No. 14/509,411, filed Oct. 8, 2014, now U.S. Pat. No. 9,241,603. This application claims priority to, and incorporates herein by specific reference, each of the above referenced applications.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to hose couplings for use with vacuum accessories and attachments, and more specifically, are related to vacuum cleaner connections that allow the vacuum accessory to swivel while maintaining the position of the connected hose or wand.

Description of the Related Art

Couplings are used to releasably attach hoses to various types of apparatuses. In a wet/dry vacuum cleaner, for example, a coupling is typically used to connect the hose to a vacuum tank or canister. A second coupling may be used to attach the remaining end of the hose to an accessory such as a vacuum attachment. The engagement of the coupling and the hose is preferably releaseable so that the hose may be quickly attached to and removed from the vacuum tank, and so that various vacuum attachments may be used as needed. In addition, it is advantageous for the couplings to allow the hose to swivel, to position the vacuum attachment as needed and to prevent the hose from kinking during use.

U.S. Pat. No. 4,625,998 discloses a swivel hose coupling 1 for attachment to a flexible hose 2. The swivel hose coupling 1 includes a swivel insert 3 for attachment to the hose, and a swivel hose end piece 4 which is rotatably connected to the hose end by the swivel insert. The swivel insert 3 is molded in the form of a sleeve 6 with an internal thread 7. The hose 2 has an external spiral thread 5 which is complementary to the internal thread 7 of the swivel insert 3 so that the swivel insert 3 may be screwed onto the end of the hose 2. To assemble the swivel hose coupling 1, the swivel hose end piece 4 must be heated to make it pliable so that the swivel insert 3 can be pushed into the end piece 4. As a result, the swivel hose coupling is overly complex and difficult to assemble, and uses a threaded connection, which may become unscrewed, to engage the hose and the coupling.

Vacuum cleaners and, in particular, those of the canister type typically include a nozzle assembly for coupling with a wand that, in turn, connects to the canister. Because it is advantageous to manipulate the wand relative to the nozzle assembly for various reasons, many in the art have proposed different types of specialized connectors for this purpose. An example of one such arrangement is disclosed in U.S. Pat. No. 4,700,429 to Martin, et al., which includes a swivel-type connector for enabling rotational movement of a handle associated with the wand. While the arrangement shown in the '429 patent does indeed permit the desired rotational movement, it is not without limitations. For one, the swivel connector itself includes the electrical coupling for the wand and, thus, requires a tubular piece intermediate the wand and the swivel connector to provide the desired ability to rotate. This type of arrangement also includes many parts to achieve the coupling, and, thus, would be not only complicated to use, but also expensive to produce and maintain.

Accordingly, what is needed is a swivel-type assembly that overcomes the problems described above. The inventions disclosed and taught herein are directed to swivel linkages for use with vacuum accessory tools, wherein the linkages serve as multi-axis swivel assemblies.

BRIEF SUMMARY OF THE INVENTION

The objects described above and other advantages and features of the invention are incorporated in the application as set forth herein, and the associated appendices and drawings, related to swivel assemblies and swivel assembly systems for connecting a vacuum wand or hose associated with a vacuum cleaner to a nozzle assembly of a vacuum accessory tool, such as a floor tool. Further described are floor tools designed so as to allow such a swivel attachment while maintaining efficient debris pick up during use.

Described are swivel systems and swivel assemblies for connecting a vacuum appliance to a vacuum accessory. The assemblies can include first and second arcuate members that each includes a tab and a receiving section so the latter can receive the other member's tab. The assembly can be adapted to be coupled to the accessory to permit the appliance to pivot relative to the accessory about two independent axes. The swivel system can include a vacuum adapter and a connector adapted to permit the vacuum adapter to pivot about a vacuum accessory. A plenum chamber can be formed in the adapter that is in fluid communication with one or more vacuum hoses to balance the airflow within the adapter. With the swivel systems and assemblies described herein, the versatility and efficiency of vacuum appliances and other tools can be improved through their multi-axes rotational capabilities and balanced airflow configurations.

The disclosure also provides a swivel assembly for connecting a vacuum appliance to a vacuum accessory. The swivel assembly can include a first arcuate member that can include a first tab and a first receiving section and a second arcuate member that can include a second tab and a second receiving section. The first tab can be adapted to be received by the second receiving section to form the assembly. Likewise, the second tab is adapted to be received by the first receiving section to form the assembly. With this configuration, the assembly can be adapted to be coupled to the accessory—for example, by being disposed between a vacuum adapter and a vacuum hose—to permit the appliance to pivot relative to the accessory.

The swivel assembly can further include first and second swivel joints adapted to each be coupled to a swivel joint connector to permit the appliance to pivot relative to the accessory along a first axis. Further, the swivel assembly can include first and second pivot slots adapted to be each coupled to the vacuum adapter to permit the appliance to pivot relative to the accessory along a second axis. In this configuration, the swivel assembly can be adapted to pivot about two independent axes relative to the accessory. Specifically, pivoting of the appliance relative to the accessory is adapted to cause rotation of the accessory in a clockwise and counterclockwise fashion by rotating a vacuum adapter in a clockwise and counterclockwise fashion, respectively.

The disclosure also provides a swivel system that can include a vacuum adapter and a connector adapted to permit the vacuum adapter to pivot about a vacuum accessory. The swivel system can be located at or near a center of the vacuum accessory. Alternatively, the swivel system can be located at or near an end of the vacuum accessory, offset from the center. The system can additionally include a first vacuum hose adapted to couple a first air inlet of the adapter to a first air outlet of the accessory and a plenum chamber, wherein the plenum chamber is formed within a portion of the adapter. The adapter can pivot relative to the accessory about a longitudinal axis of the first vacuum hose.

The swivel system can further include a second vacuum hose adapted to couple a second air inlet of the adapter to a second air outlet of the accessory and the accessory can include at least two vacuum inlets. With the first and second air inlets of the adapter, the plenum can be formed between the two inlets to balance airflow within the adapter. Further, debris received by the vacuum adapter is adapted to flow through the vacuum inlets to at least two vacuum hoses, such as the first and second vacuum hoses.

Further, the adapter can include a second air outlet. In one configuration, the first and second air outlets can be spaced approximately equally from terminal edges of the accessory and the distance between the first and second air outlets can be approximately equal to one half of the total distance between the terminal edges of the accessory.

The disclosure also provides a swivel system that can include a vacuum appliance and a swivel assembly. The system's assembly can include a first arcuate member that can include a first tab and a first receiving section and a second arcuate member that can include a second tab and a second receiving section. The first tab can be adapted to be received by the second receiving section to form the assembly. Likewise, the second tab can be adapted to be received by the first receiving section to form the assembly. With this configuration, the assembly can be adapted to be coupled to the accessory—for example, by being disposed between a vacuum adapter and a vacuum hose—to permit the appliance to pivot relative to the accessory.

The system's assembly can further include first and second swivel joints adapted to each be coupled to a swivel joint connector to permit the appliance to pivot relative to the accessory along a first axis. Further, the system's assembly can include first and second pivot slots adapted to be each coupled to the vacuum adapter to permit the appliance to pivot relative to the accessory along a second axis. In this configuration, the swivel assembly can be adapted to pivot about two independent axes relative to the accessory. Specifically, pivoting of the appliance relative to the accessory is adapted to cause rotation of the accessory in a clockwise and counterclockwise fashion by rotating a vacuum adapter in a clockwise and counterclockwise fashion, respectively.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
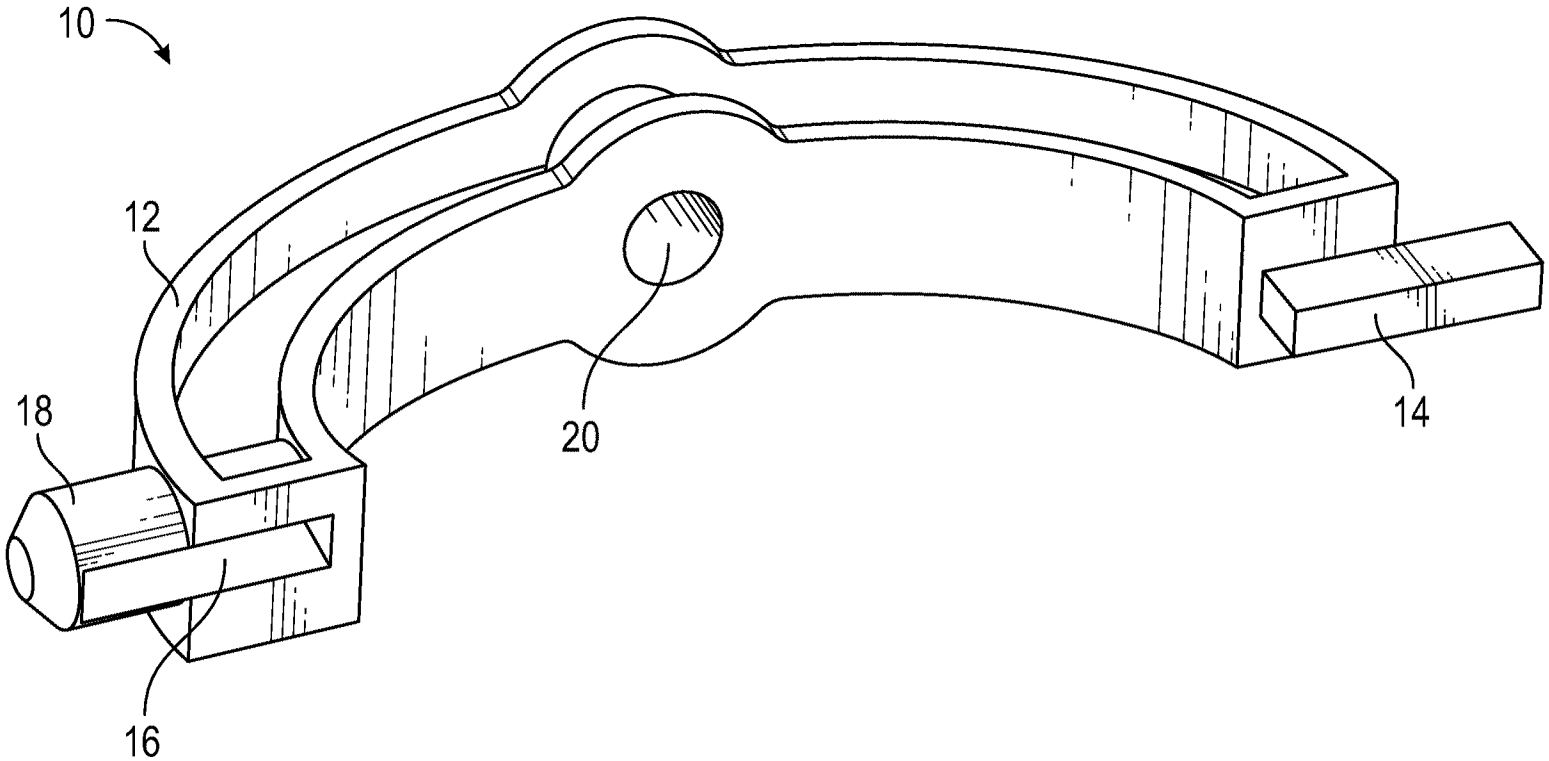
FIG. 1 illustrates an arcuate member of an exemplary swivel link assembly.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicant has invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicant has created swivel link assemblies for use with vacuum accessories and vacuum floor tools, the swivel assemblies connecting a vacuum accessory to a vacuum cleaner via a wand or hose and allowing for multiple degrees, or axes, of freedom of movement.

Figure 2:
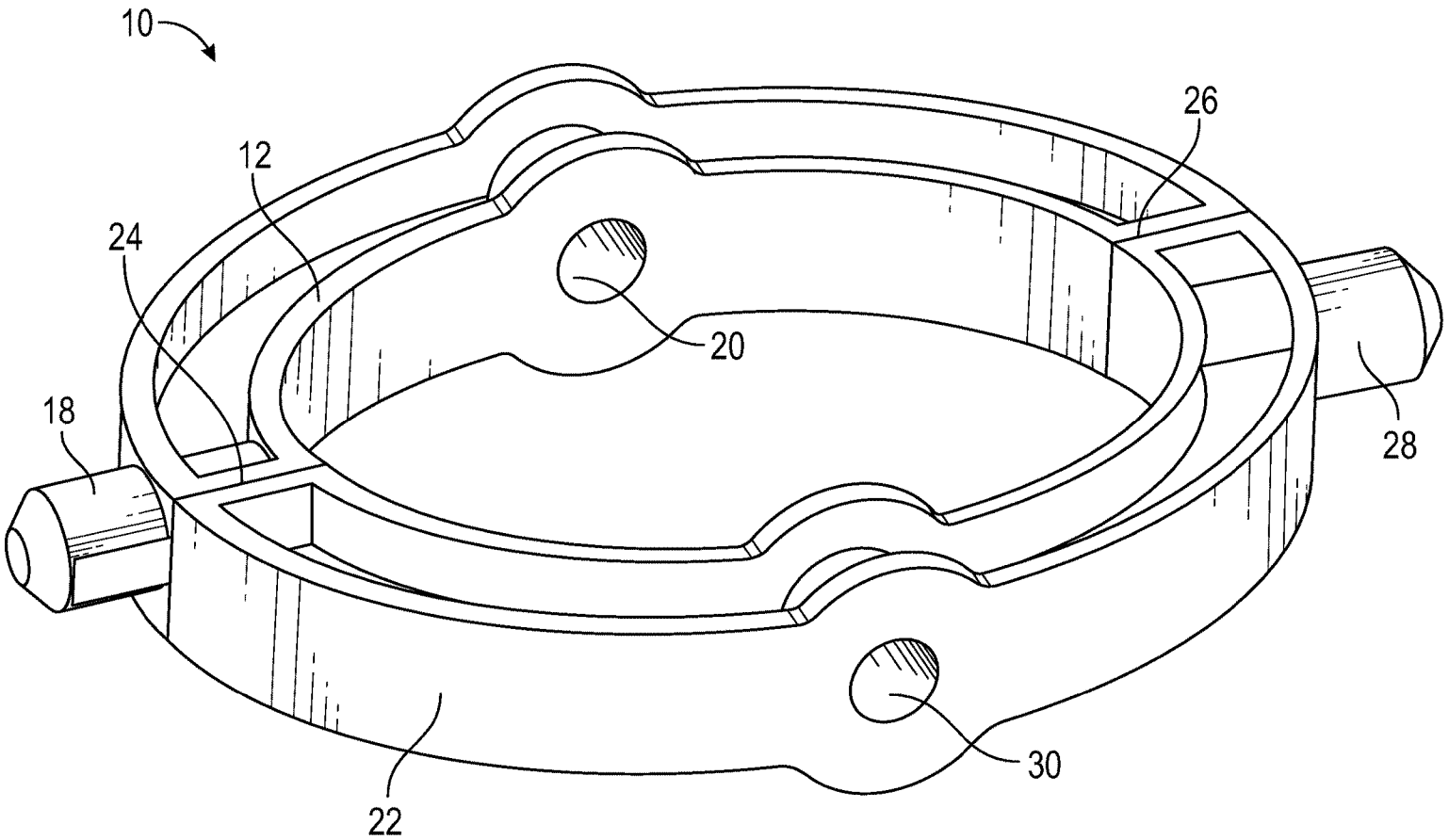
FIG. 2 illustrates an exemplary swivel link assembly of the present disclosure, the assembly combining two of such members illustrated FIG. 1.

Turning now to the figures, these drawings illustrate several of the specific concepts of the present disclosure. FIG. 1 illustrates an arcuate member of an exemplary swivel link assembly. FIG. 2 illustrates an exemplary swivel link assembly of the present disclosure, the assembly combining two of such members illustrated FIG. 1. These figures will be described in conjunction with one another.

With specific reference to FIG. 1, swivel linkage assembly 10 (alternatively referred to throughout as "swivel assembly" or simple, "assembly") can include a first arcuate member 12 that can include a first tab 14, a first receiving section 16, a first swivel joint 18, and first pivot slot 20. With specific reference to FIG. 2, assembly 10 can include second arcuate member 22 that can include a second tab (not shown), a second receiving section (not shown), a second swivel joint 28, and second pivot slot 30. First and second swivel joints (18 and 28, respectively) can be adapted to couple with one or more swivel joint connectors 32 (as illustrated, for example, with reference to FIGS. 4A and 4B).

Figure 4A:
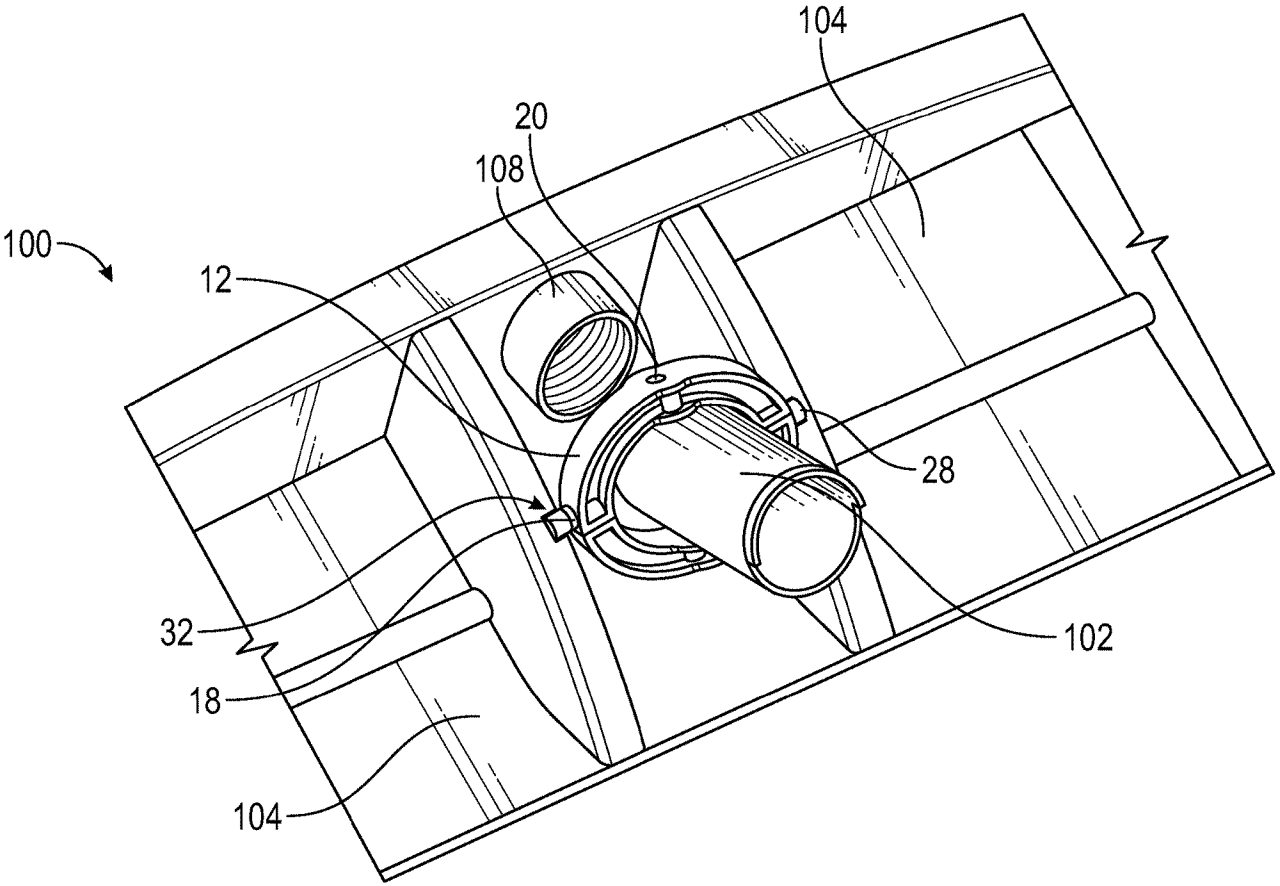
FIG. 4A illustrates a first perspective view of the swivel link assembly of FIG. 2 in use with a vacuum accessory.
Figure 4B:
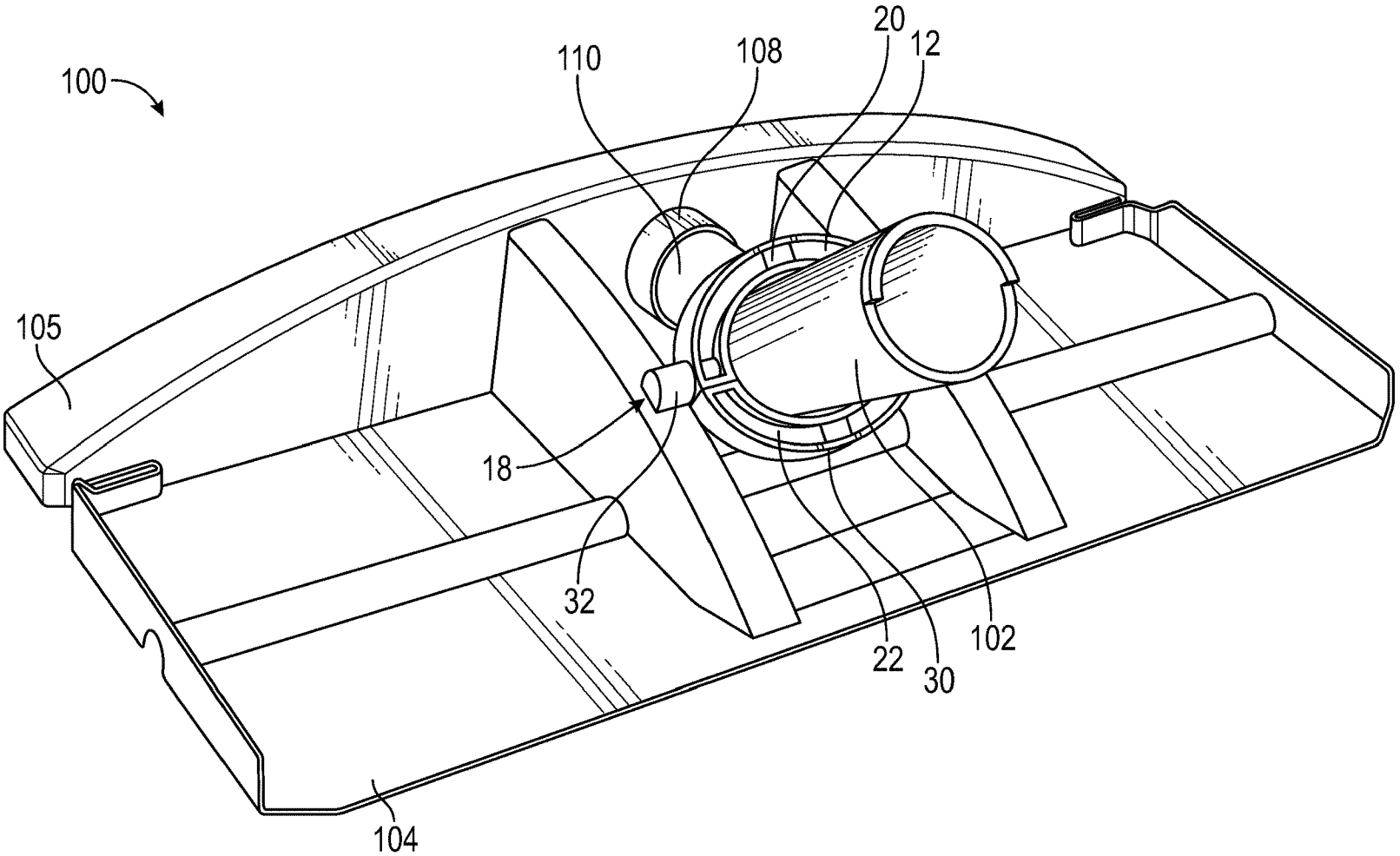
FIG. 4B illustrates a second perspective view of the swivel link assembly of FIG. 2 in use with a vacuum accessory.

Assembly 10 (as illustrated FIG. 1) illustrates a subset of the components that comprises the entire swivel assembly. For the example illustrated in FIGS. 1 and 2, first arcuate member 12 and second arcuate member 22 are identical components that are adapted to couple together by coupling opposite ends of each respective member to the other. For example, FIG. 2 illustrates second arcuate member 22 as being identical to first arcuate member 12 (as illustrated in FIG. 1) such that first tab 14 (of first member 12) is adapted to be received by the second receiving section (not shown) of second member 22 (coupled at second couple joint 26) to form the assembly 10. Likewise, the second tab (not shown) is adapted to be received by the first receiving section 16 to form the assembly 10 (coupled at first couple joint 24). With this configuration, the assembly 10 can be adapted to be coupled to accessory 104 (for example, as illustrated in FIGS. 4A and 4B).

Although FIGS. 1 and 2 illustrate first and second arcuate members (12 and 22, respectively) as identical features coupled in a mirrored configuration, other configurations are contemplated as well. For example, first and second arcuate members (12 and 22, respectively) can be configured as non-identical and/or non-mirrored components. In other examples, one or more of first and second arcuate members (12 and 22, respectively) can be configured as shapes other than arcs or curves. For example, one or more of first and second arcuate members (12 and 22, respectively) can be formed in a rectangular, square, or other suitable polygonal shape. In yet other examples, assembly 10 can be formed as one single monolithic unit. In these examples, one or more of the tabs 14 and receiving sections 16 can be omitted. Because assembly 10 is a single, inseparable component in this particular example, and couple joints 24 and 26 can be omitted as well.

Figure 3A:
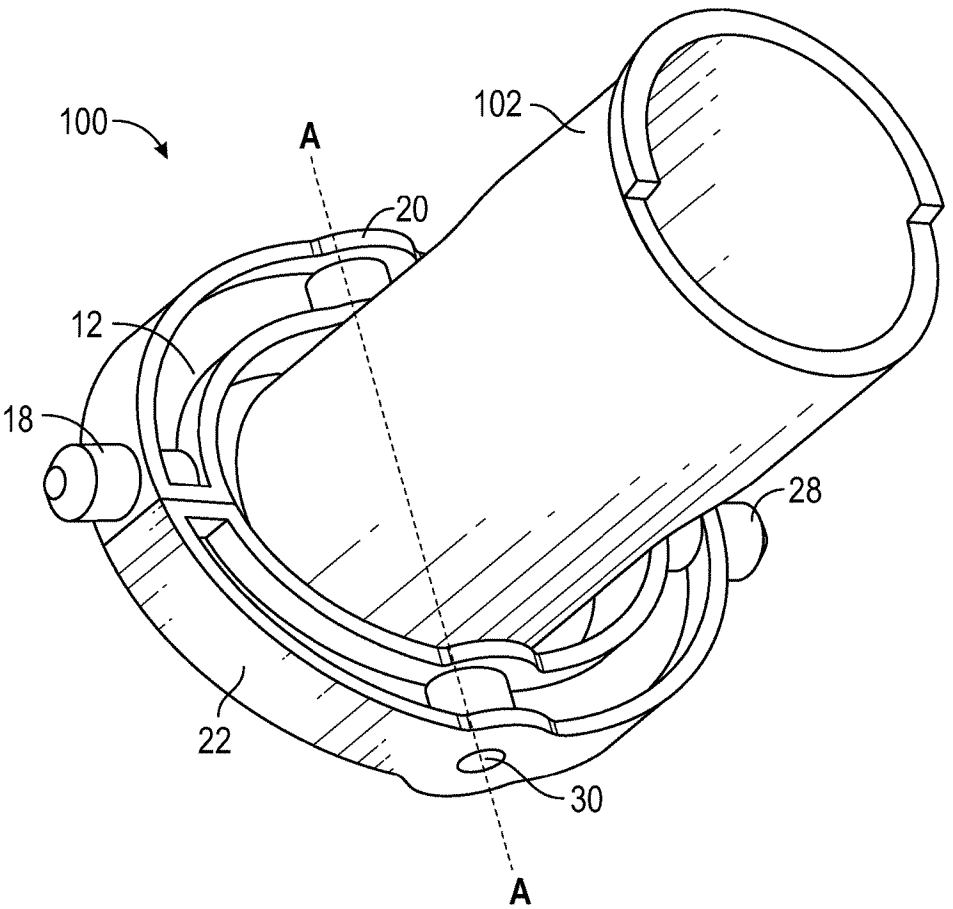
FIG. 3A illustrates a first embodiment of a swivel system including an exemplary assembled swivel link assembly in accordance with aspects of the present disclosure.

As described in greater detail with reference to FIG. 3A, assembly 10 is configured such that an inner portion is adapted to receive a vacuum adapter 102. Because vacuum adapters are often cylindrically shaped, first and second arcuate members (12 and 22, respectively) are often formed in an arcuate fashion to form a cylindrical cavity for receiving vacuum adapter 102 (as illustrated in FIG. 3A). Because vacuum adapter 102 can take various shapes other than cylindrical, member 10 and 12 so be shaped accordingly to receive the various forms of adapter 102.

Tab 14 can include any flange, protrusion, post, knob, or the like that can be received by receiving section 16. Tab 14 can be coupled to first and second members 12 and 22, respectively or, in the alternative, formed as a single monolithic piece with the remaining elements of assembly 10. Receiving section 16 can include any indentation, cavity, cutout, or the like for receiving a tab of the other member. For example, receiving section 16 of member 10 can be configured to be an inverted structure of the precise shape and size of member's 22 tab (not shown) such that receiving section 16 can interlock with the tab such that the tab is disposed entirely (or, alternatively, at least substantially) within receiving section 16.

Each of member 10 and 12 can include swivel joints 18 and 28, respectively. Swivel joints 18 and 28 can include any bump, protrusion, flange, or the like for permitting rotation about its longitudinal axis. For example, if joints 18 and 28 are cylindrically shaped as illustrated in FIGS. 1 and 2 for example, assembly 10 can rotate about these cylinders' longitudinal axis (e.g., such that first and second pivot slots 20 and 30, respectively) can move in a vertical direction (e.g., along the z-axis of a three-dimensional Cartesian coordinate system).

First and second pivot slots 20 and 30, respectively, can include any cutaway, cavity, indentation, or the like within members 12 and 22, respectively, for receiving a pivot coupler (not shown). Alternatively, first and second pivot slots 20 and 30, respectively, can be replaced with the pivot coupler. The interactions between first and second pivot slots 20 and 30, respectively, the pivot coupler (not shown) and vacuum adapter 102 (as shown, for example, in FIG. 3A), are discussed in greater detail below.

Figure 3B:
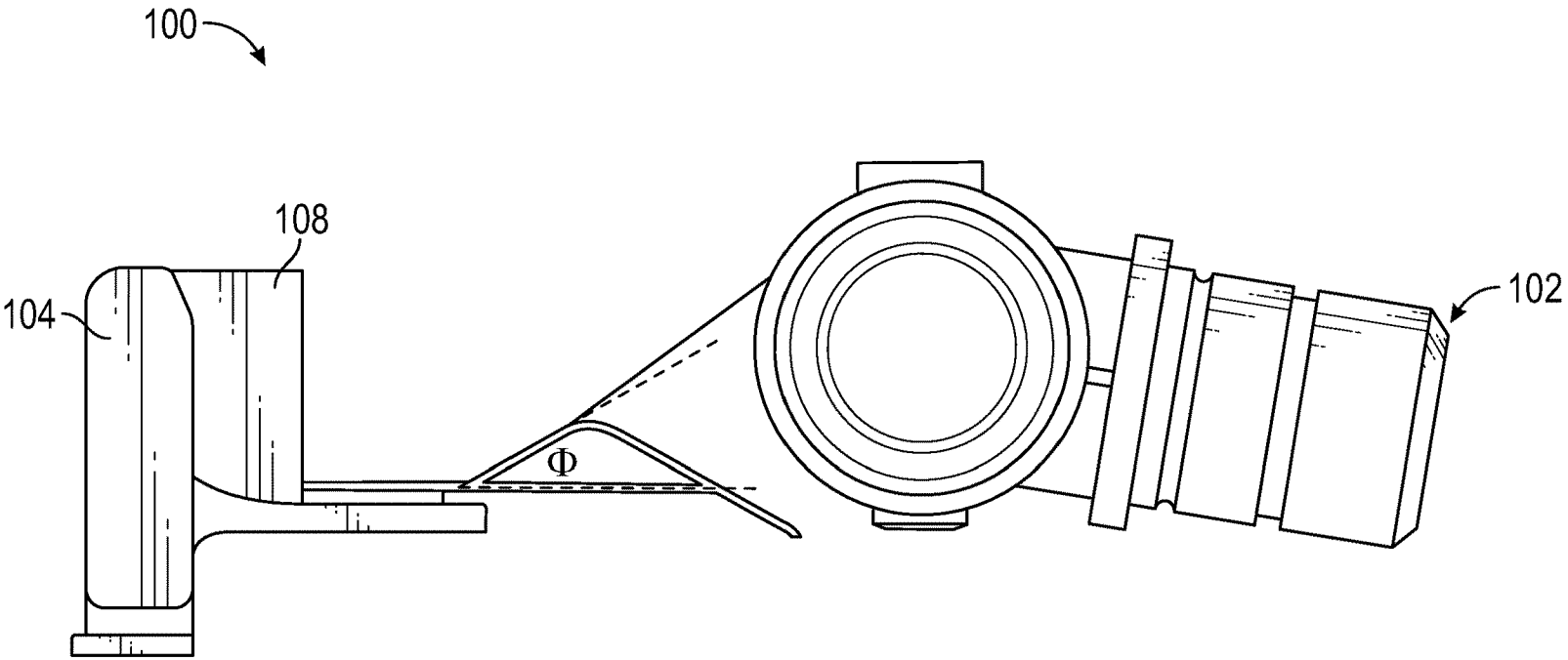
FIG. 3B illustrates a side view of the assembly of FIG. 2 in accordance with aspects of the present disclosure.

FIG. 3A illustrates a first embodiment of a swivel system including an exemplary assembled swivel link assembly in accordance with aspects of the present disclosure. FIG. 3B illustrates a side view of the assembly of FIG. 2 in accordance with aspects of the present disclosure. FIG. 4A illustrates a first perspective view of the swivel link assembly of FIG. 2 in use with a vacuum accessory. FIG. 4B illustrates a second perspective view of the swivel link assembly of FIG. 2 in use with a vacuum accessory. These figures will be described in conjunction with one another.

First vacuum pivot system 100 can include assembly 10 (as described, for example, in FIGS. 1 and 2, above), vacuum adapter 102, accessory 104, vacuum head 105. System 100 can additionally include air inlet 108 and conduit 110 that can be adapted to be disposed between vacuum adapter 102 and air inlet 108.

Assembly 10 can be coupled with accessory 104 by coupling first swivel joint 18 to swivel joint connector 32. Additionally, second swivel joint 28 can be coupled to swivel joint connector 32 on a distal, opposite side of assembly 10. Adapter 102 can be coupled to assembly 10 (for example, though a snap-type connection or the like) such that a portion of adapter 102 is disposed within an inner portion of assembly 10 as illustrated, for example, in FIG. 3A.

With particular reference to FIG. 3A, adapter 102 can be coupled to first and second pivot slots 20 and 30, respectively, so that adapter 102 can pivot about axis A-A with the aid of a pivot coupler (not shown). Pivot coupler can include a pin, bar, or the like, for passing through, or coupling to, adapter 102 such that adapter 102 can rotate about axis A with pivot coupler coupled to first and second pivot slots 20 and 30, respectively. In this configuration, pivot coupler (not shown) can remain fixed relative to first and second pivot slots 20 and 30, respectively, as adapter 102 rotates about the pivot coupler (and accessory 104 as shown, for example, in FIGS. 4A and 4B).

Vacuum adapter 102 can include any hose, wand adapter, or adapter for receiving a wand, or other vacuum accessory. For example, vacuum adapter 102 can receive a vacuum wand (e.g., a standard 1.5 inch inner diameter vacuum wand) by way of friction-fit so that the wand is coupled to vacuum adapter 102 by inserting the wand into the adapter. Once coupled, the two can be rigidly coupled such that movement of one will effect movement of the other. In this configuration, by manipulating the movement of the wand, an operator can manipulate movement of the adapter 102 to control accessory 104. Further, the tool coupled to adapter 102 can be bent, such as an elbow-style connection, such that it rotates about the adapter as an operator rotates in accordance with the description as described in greater detail below with reference to FIGS. 5A and 5B.

Accessory 104 can include one or more vacuum accessories such as brushes, crevice tools, wands extensions, nozzles (e.g., tapered, etc.), squeegees, or the like. With particular reference to FIGS. 4A and 4B, accessory 104 includes an accessory head, such as mop attachment for cleaning hard surfaces, such as tile, hardwood flooring, etc. Accessory 104 can include a vacuum head 105 to provide accessory 104 with the ability to vacuum dust and debris as accessory 104 provides additional surface cleaning. Accessory 104 can include a mop accessory 216 and vacuum head 105 can receive the dust and debris through vacuum inlet 218 (both of which are illustrated, for example, in FIG. 9D).

Vacuum head 105 receives dust and debris, for example, though vacuum suction created by a vacuum (such as, for example, a wet/dry vacuum). The suction created causes the dust and debris to travel from vacuum head 105 to first air inlet 108 and into conduit 110 which can be communicatively coupled with vacuum adapter 102. Conduit can include any pipe, tube, vacuum hose, or the like for connecting air inlet 108 to adapter 102. Conduit can be constructed of a flexible-type material (such as a fluted flex hose) or, in the alternative, may be rigid with an additional joint (not shown) to permit assembly 10 to rotate about its various axes as described in greater detail below.

When system 100 is assembled (for example, as illustrated in FIGS. 4A and 4B), assembly 10 adapted to pivot about two independent axes relative to the accessory (e.g., about the cylindrical axis of first and second swivel joints 18 and 28, respectively and about axis A-A as illustrated, for example, in FIG. 3A). FIG. 3B illustrates the relative movement of adapter 102 relative to other features of system 100 as adapter 102 rotates about this axis. As illustrated in FIG. 3B, adapter 102 can pivot about its axis by sweeping through angle Φ (along the z-axis of a three-dimensional Cartesian coordinate system). In one example, as Φ decreases, the vertical distance between a cleaning surface and the adapter 102 decreases and vice versa.

Figure 5B:
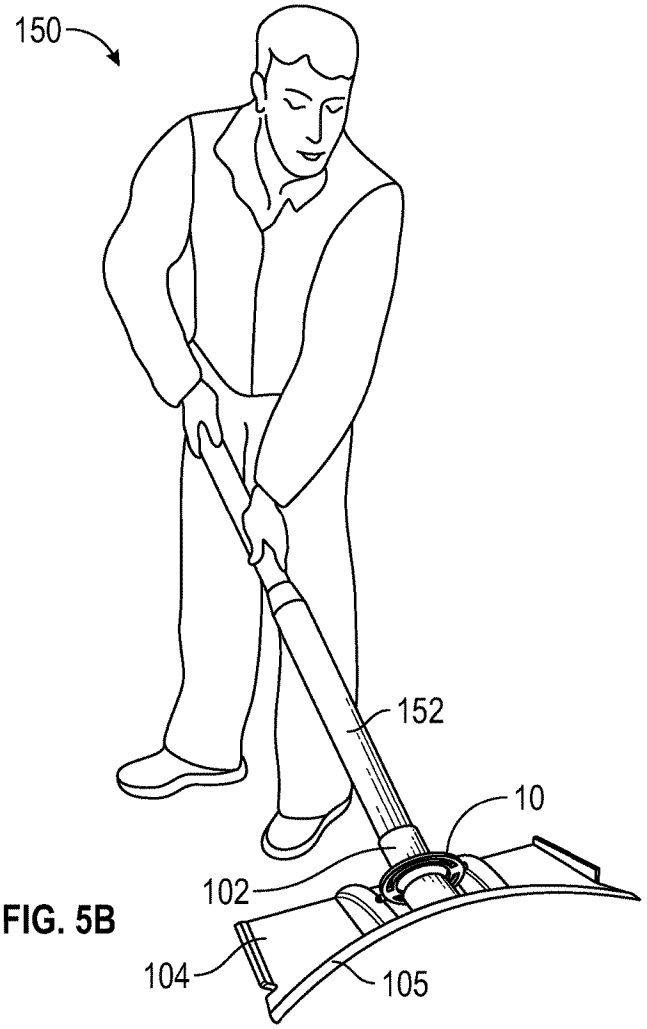
FIG. 5B illustrates an environmental view of the exemplary swivel system illustrated in FIG. 5A.
Figure 5A:
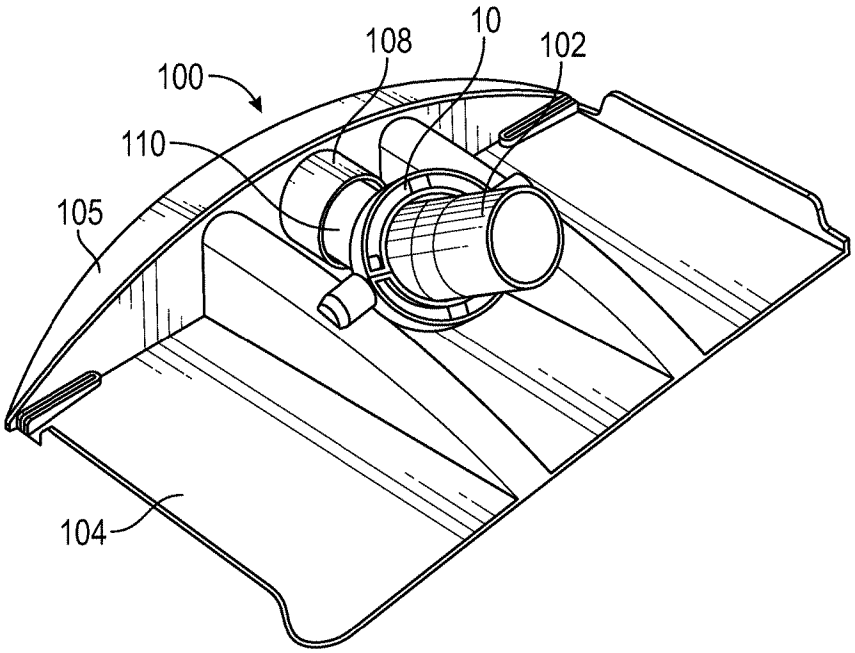
FIG. 5A illustrates a perspective view of an exemplary swivel system in accordance with certain aspects of the present disclosure.

FIG. 5A illustrates a perspective view of an exemplary swivel system in accordance with certain aspects of the present disclosure. FIG. 5B illustrates an environmental view of the exemplary swivel system illustrated in FIG. 5A. These figures will be described in conjunction with one another.

System 150 can include assembly 10, accessory 104, vacuum head 105, and vacuum appliance 152. Further, system 150 can include first air inlet 108 and conduit 110, such as a vacuum hose or the like. With specific reference to the rotation described above, the combined rotation of adapter 102 relative to accessory 104 permitted by assembly 10 in this configuration provides the manner for which the adapter 104 and/or vacuum appliance 152 can effect rotation of the accessory 104 with the assembly interfering with other elements of system 150.

Specifically, pivoting of the appliance 152 relative to the accessory 104 is adapted to cause rotation of the accessory 104 in a clockwise and counterclockwise fashion by rotating a vacuum adapter 102 in a clockwise and counterclockwise fashion, respectively. In other words, as an operator turns and/or angles the appliance to the left, the accessory 104 will rotate to the left accordingly, and as an operator turns and/or angles the appliance 152 to the right, the accessory 104 will rotate to the right accordingly. With these two axes of rotation, accessory 104 would not remain coplanar with the cleaning surface, thus lowering the effectiveness of the cleaning tool. Finally, appliance 152 can include hoses, tubes, wands, or the like. Additionally, appliance 152 can be coupled to a vacuum (not shown) such as a wet/dry vacuum or the like.

Figure 6A:
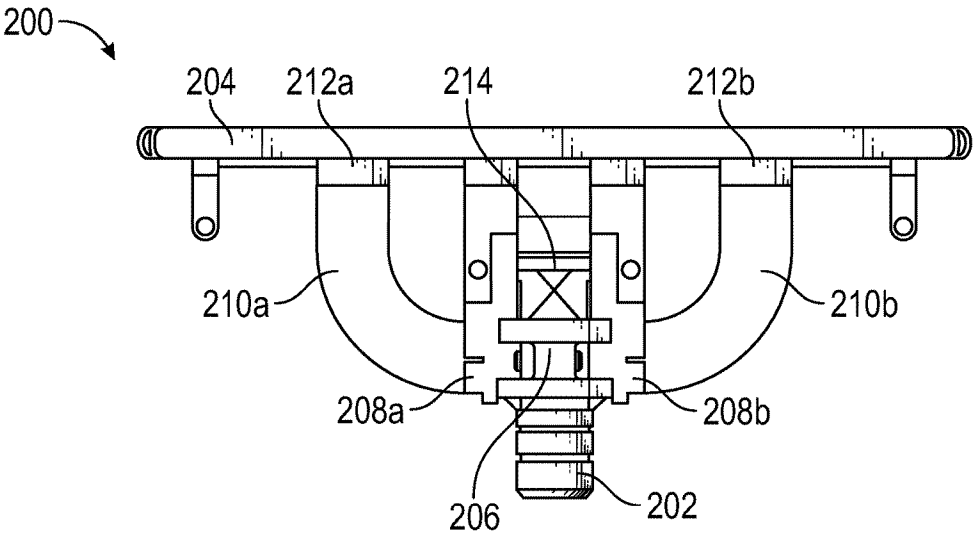
FIG. 6A illustrates a top view of a second embodiment of a swivel system in accordance with certain aspects of the present disclosure.
Figure 6C:
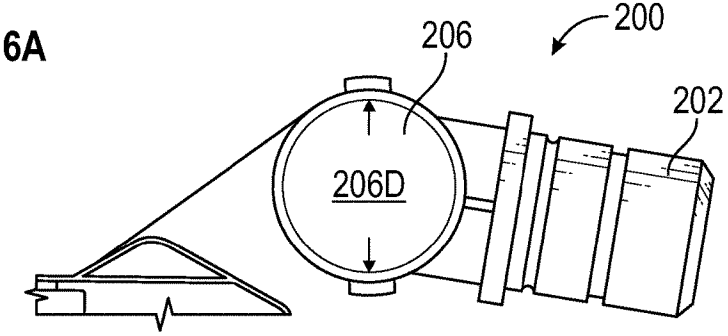
FIG. 6C illustrates a cross-sectional view of the second embodiment of a swivel system illustrated in FIG. 6A with particular focus on the plenum chamber created within the vacuum adapter.
Figure 6B:
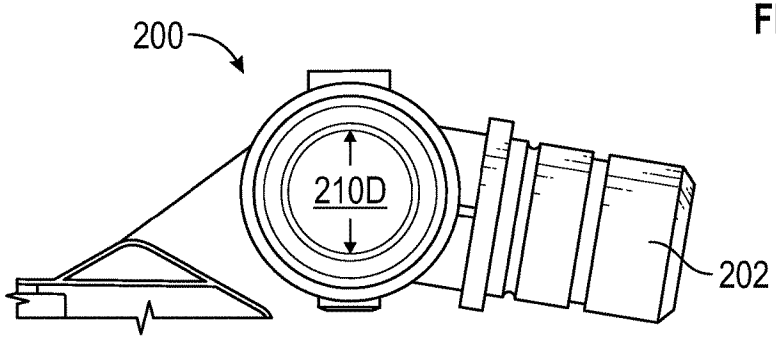
FIG. 6B illustrates a cross-sectional view of the second embodiment of a swivel system illustrated in FIG. 6A.

FIG. 6A illustrates a top view of a second embodiment of a swivel system in accordance with certain aspects of the present disclosure. FIG. 6B illustrates a cross-sectional view of the second embodiment of a swivel system illustrated in FIG. 6A. FIG. 6C illustrates a cross-sectional view of the second embodiment of a swivel system illustrated in FIG. 6A with particular focus on the plenum chamber created within the vacuum adapter. These figures will be described in conjunction with one another.

System 200 can include vacuum adapter 202, accessory 204, one or more first air inlets 208, and a plenum chamber 206 adapted to be formed between first air inlets 208*b* within a portion of the adapter 202. Adapter 202 and accessory 204 can be similarly embodied as adapter 102 and accessory 104, respectively, as described in greater detail above with reference to FIGS. 3-4). Additionally, system 200 can include one or more first air outlets 212, one or more conduits 210, and a connector 214. Conduits 210 can include any vacuum hose, tube, or the like (i.e., similarly embodied as conduit 110 described above with references to FIGS. 4A and 4B) for commutatively coupling first air inlets 208 to one or more of the first air outlets 212 of accessory 204.

Connector 214 can include any coupler, joint, actuator, or the like that can be adapted to permit the vacuum adapter 202 to pivot about a vacuum accessory 214. For example, adapter 202 can pivot relative to the accessory 204 about a longitudinal axis of the conduit at the point at which is coupled to the first air inlets 208. In this example, connector 214 can cause adapter 202 to pivot in a similar fashion with respect to accessory 204 as described above with reference to FIG. 3B.

In one example, swivel system 200 include a first conduit 210 coupled between first air outlet 212*a* and first air inlet 208*a*. Similarly, a second conduit 210*b* can be coupled between second air outlet 212*b* and second air inlet 208*b*. With the first and second air inlets (208*a*, 208*b*, respectively) of the adapter 202, the plenum camber 206 can be formed between the two inlets to balance airflow within the adapter 202. In this example, debris received by the vacuum adapter 202 is adapted to flow through the vacuum inlets 218 (as illustrated in FIG. 9D, for example) to at least two vacuum hoses or conduits, such as first and second conduits (210*a* and 201*b*, respectively).

With particular reference to FIGS. 6B and 6C, plenum chamber 206 can include any cavity, opening, or other chamber for containing liquids and/or gasses. In the examples illustrated in these figures, chamber 206 can be cylindrical in shape with a diameter 206D as measured by the inner diameter of first inlet 208, although other shapes and sizes of plenum chamber 206 are contemplated as well. In this configuration, the outer diameter of conduit 210 is equal to diameter 206 and its inner diameter (210D) is less than the diameter 206D of the plenum chamber 206. In this configuration, airflow can be balanced between conduits 210*a* and 201*b* as it separates from plenum chamber 206 to each conduit.

Figure 7:
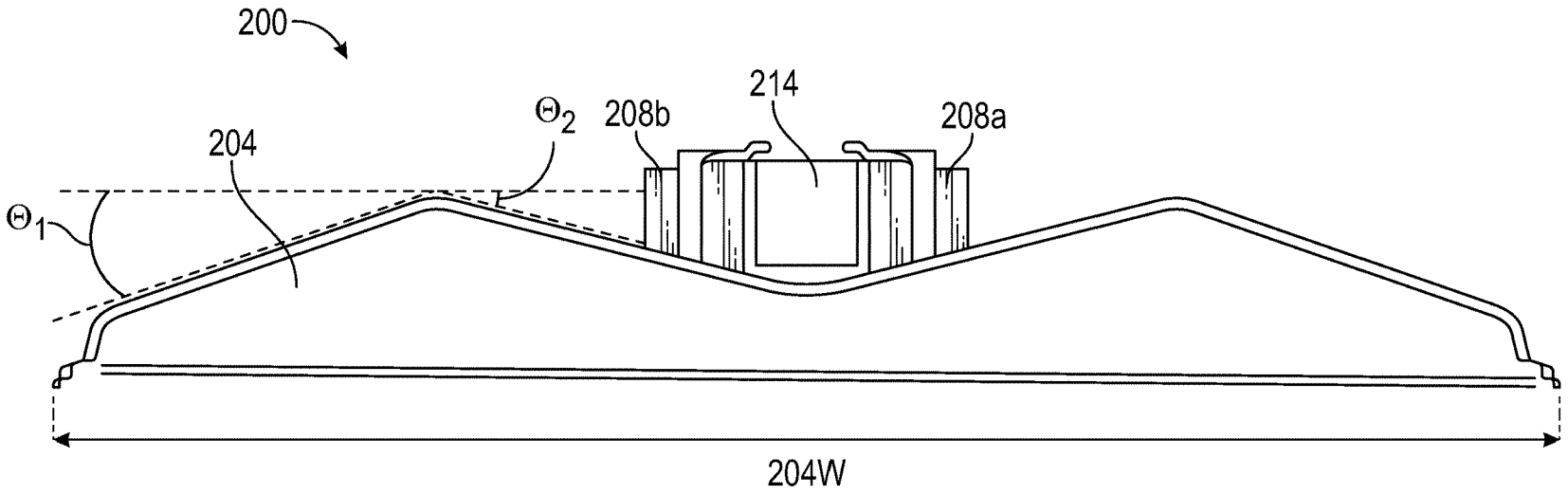
FIG. 7 illustrates a partial cut-away front view of the swivel system illustrated in FIG. 6A.
Figure 8:
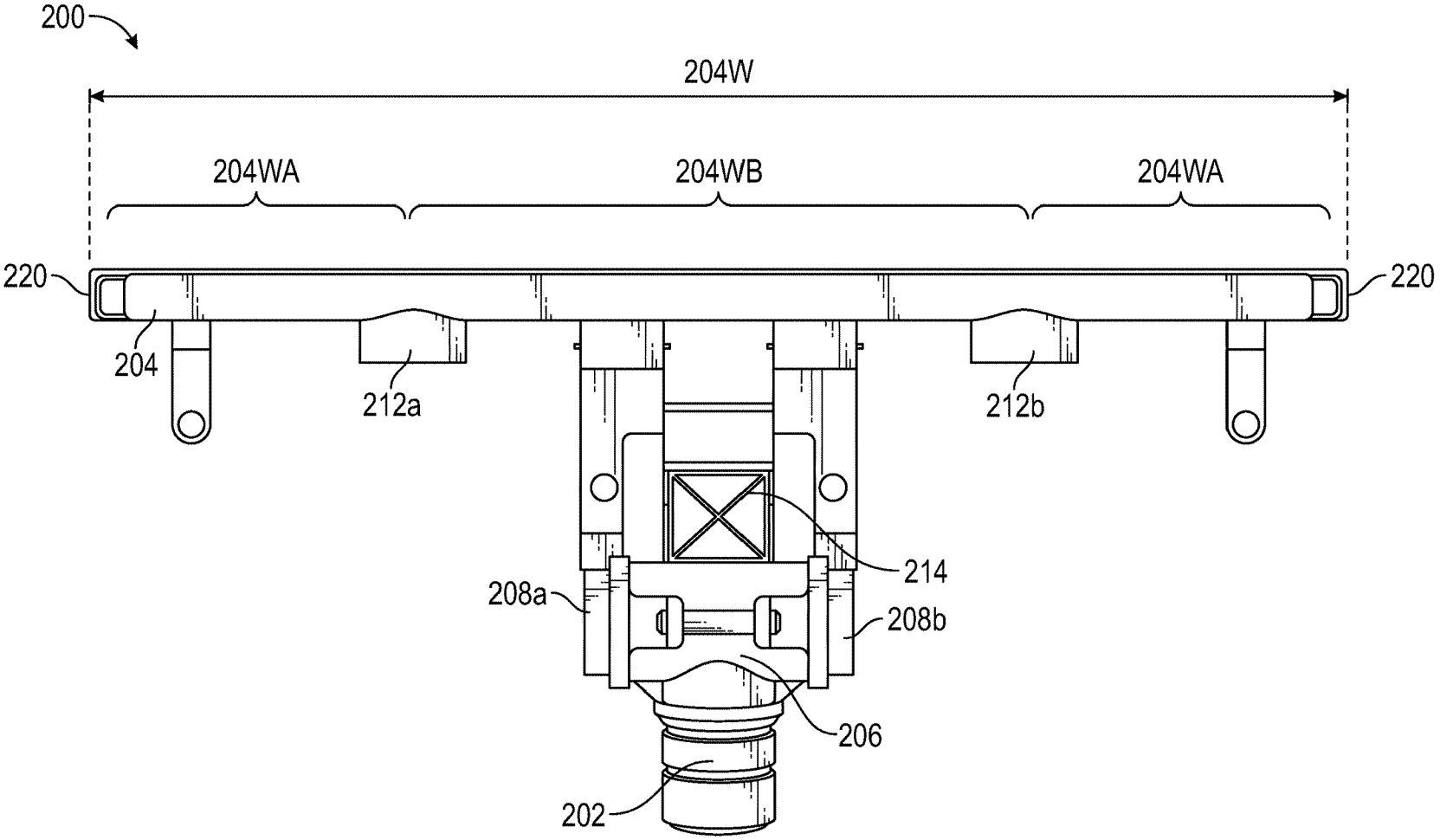
FIG. 8 illustrates a top view of the second embodiment of a swivel system illustrated in FIG. 6A with particular focus on the relative spacing of the air outlets in accordance with certain aspects of the present disclosure.

FIG. 7 illustrates a partial cut-away front view of the swivel system illustrated in FIG. 6A. FIG. 8 illustrates a top view of the second embodiment of a swivel system illustrated in FIG. 6A with particular focus on the relative spacing of the air outlets in accordance with certain aspects of the present disclosure.

Referring specifically to FIG. 7, the airflow balancing discussed in greater detail above can be accomplished by designing accessory 204 within certain parameters. For example, by adjusting the width 204W of accessory 204 and setting angles $\Theta_1$ and $\Theta_2$ appropriately, airflow can be optimized. For example, in an exemplary and non-limiting illustrative embodiment, 204W can be set to eighteen inches, $\Theta_1$ set to nineteen degrees, and $\Theta_2$ set to fifteen degrees. With this width 204W, $\Theta_1$ and $\Theta_2$ can be varied up to +/−eight degrees without a significant loss in airflow optimization. Additionally, other widths 204W and angles $\Theta_1$ and $\Theta_2$ are contemplated as well, including those with similar proportions as the example described above, although the geometry of accessory 204 is not so limited by the ranges and proportions described above.

Further optimization can be accomplished by appropriately spacing of air outlets 212*a* and 212*b* relative to the terminal edges 220 of accessory 204. For example, in an exemplary and non-limiting illustrative embodiment, the first and second air outlets (212*a* and 212*b*, respectively) can be spaced approximately equally from terminal edges 220 of the accessory 204 and the distance between the first and second air outlets (212*a* and 212*b*, respectively) can be approximately equal to one half of the total distance between the terminal edges 220 of the accessory. In this example, the distance from a terminal edge 220 to the nearest air outlet (as measured from its center point) has a width of 204WA and the distance between each air outlet (as measured from their center points) has a width of 204WB such that 2×204WA+204WB=204W. In other examples, this basic proportionality is maintained with variance within +/−20% of these values. This spacing can facilitate the airflow across the accessory's 204 entire width. Additionally, other widths and proportionalities for 204WA, 204WB, and 220 are contemplated as well, including embodiments where more than or fewer than two air outlets 212*a* and 212*b* are employed.

Figure 9A:
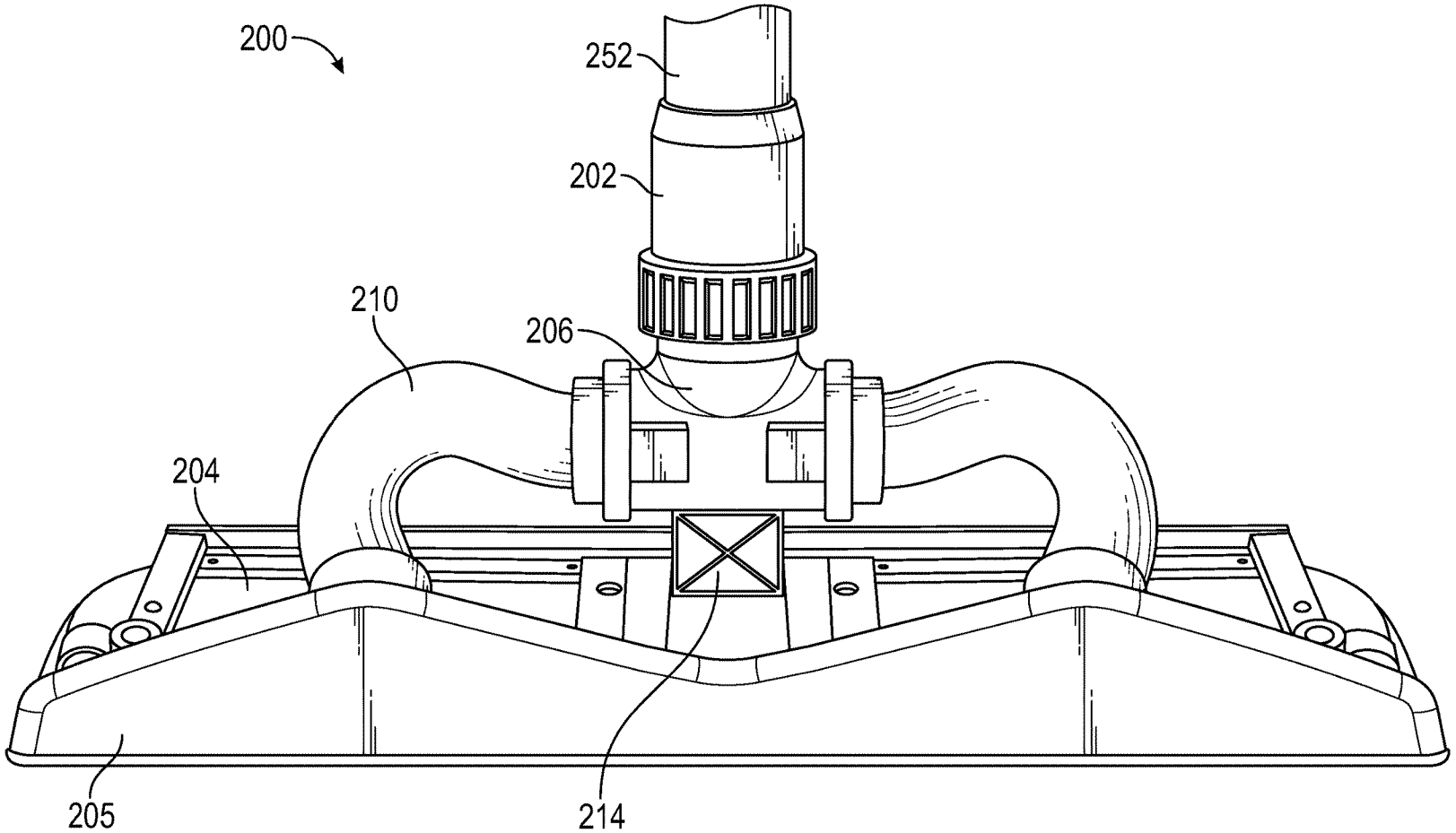
FIG. 9A illustrates a front perspective view of the assembly illustrated in FIG. 6A in accordance with aspects of the present disclosure.
Figure 9B:
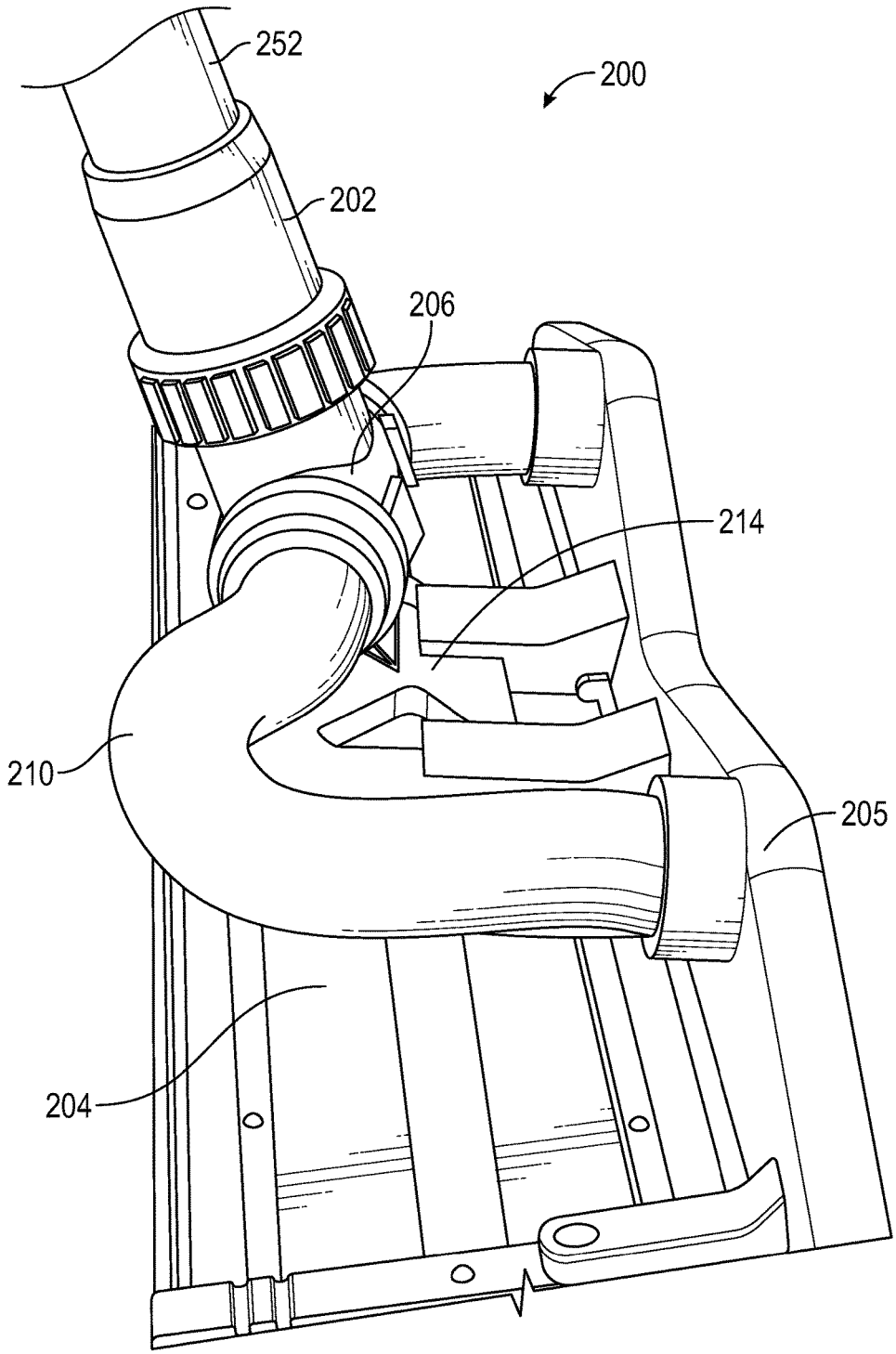
FIG. 9B illustrates side view of the assembly illustrated in FIG. 9A with the vacuum adapter in a first position.
Figure 9C:
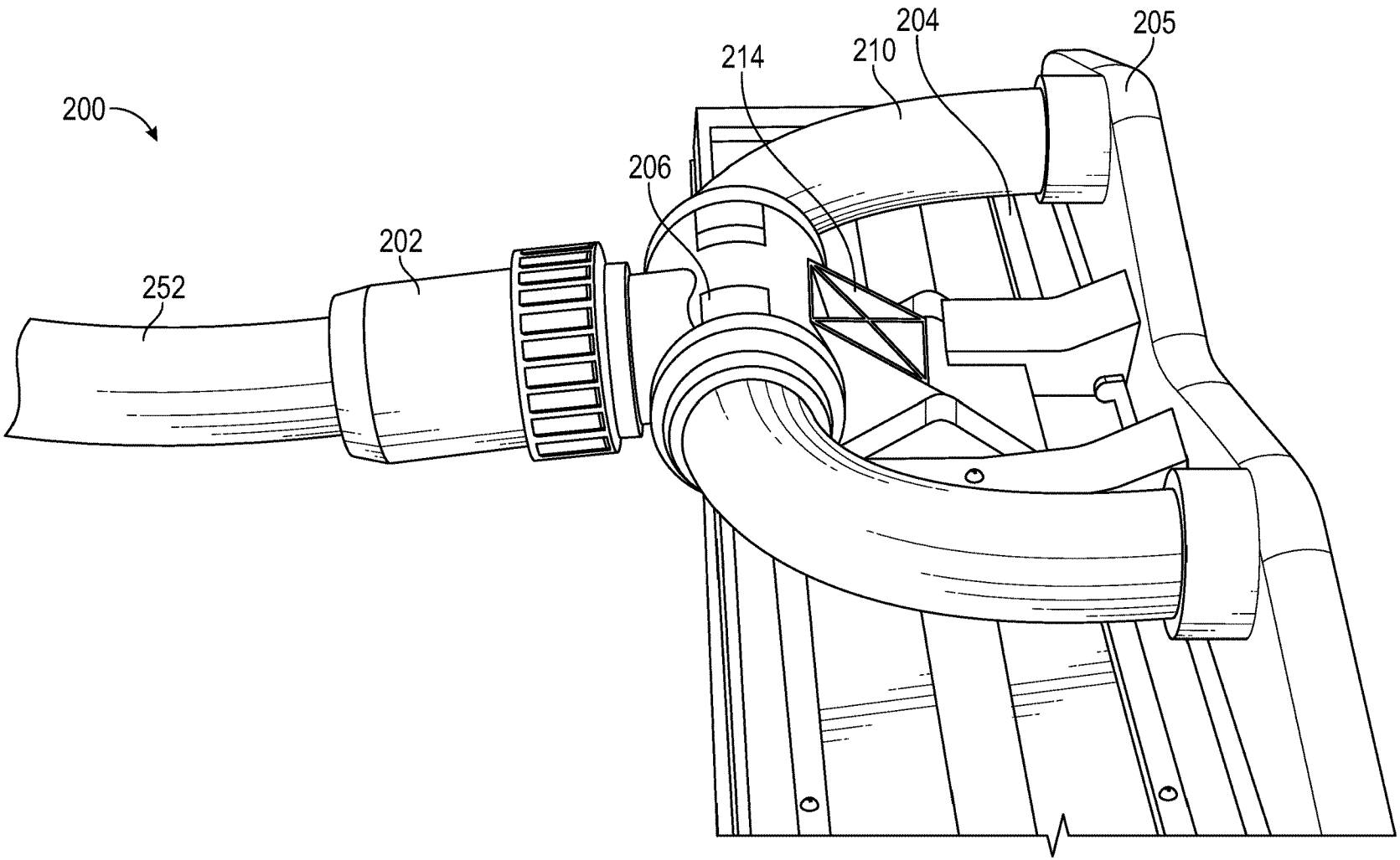
FIG. 9C illustrates side view of the assembly illustrated in FIG. 9A with the vacuum adapter in a second position.
Figure 9D:
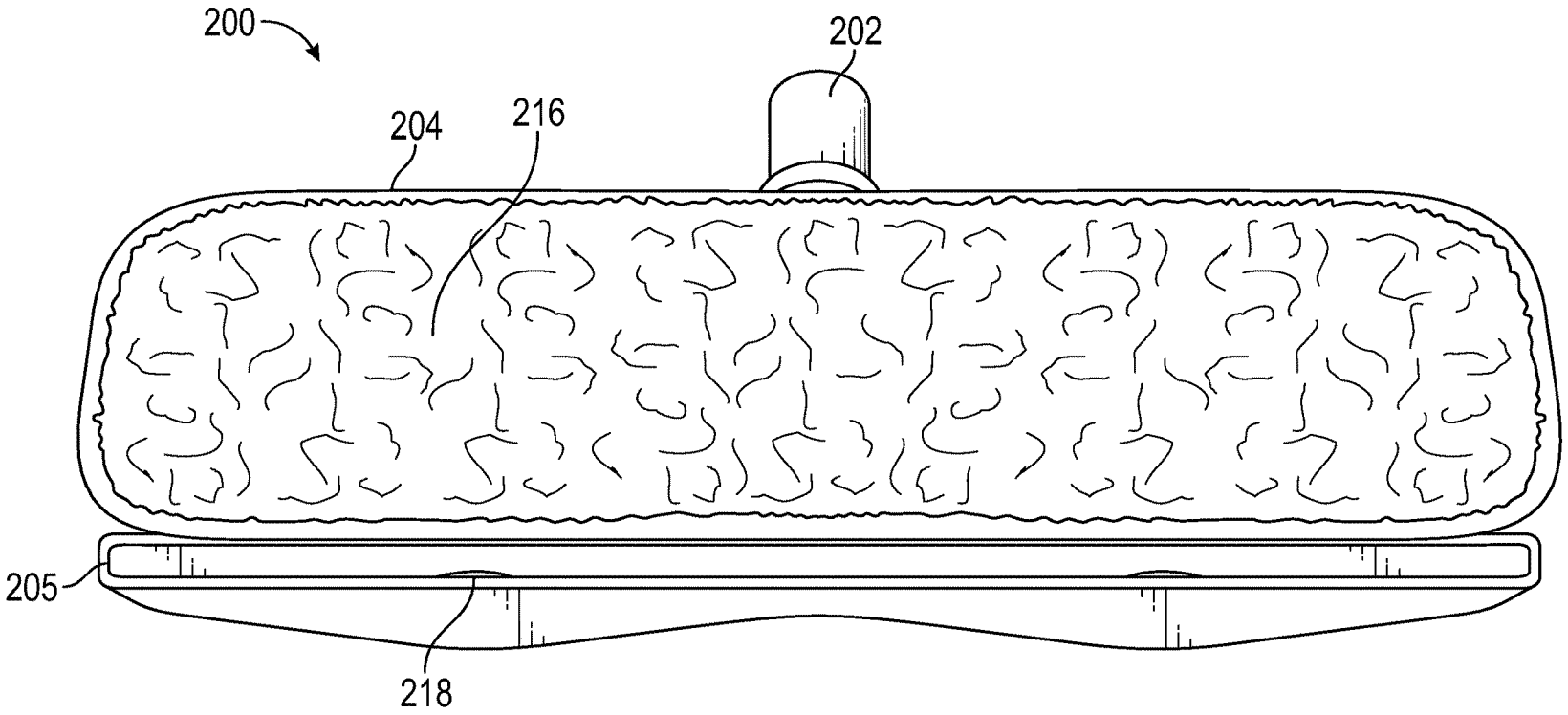
FIG. 9D illustrates bottom view of the assembly illustrated in FIG. 9A in accordance with certain aspects of the present disclosure.

Several examples of the vacuum pivot system 200 are illustrated in FIGS. 9A-9E. For example, FIG. 9A illustrates a front perspective view of the assembly illustrated in FIG. 6A in accordance with aspects of the present disclosure. In this configuration, adapter 202 is in an upright position. FIG. 9B illustrates side view of the assembly illustrated in FIG. 9A with the vacuum adapter in this first, upright position.

With reference to FIG. 9C, this figure illustrates side view of the assembly illustrated in FIG. 9A with the vacuum adapter in a second, lowered position. In this example, the angle Φ as illustrated in FIG. 3B is minimized, thus lowering adapter 202 (and the attached vacuum appliance 252) toward the cleaning surface. This configuration is particular useful, for example, when cleaning under obstacles with a lower clearance to permit accessory 204 to extend beneath the obstacle.

Figure 9E:
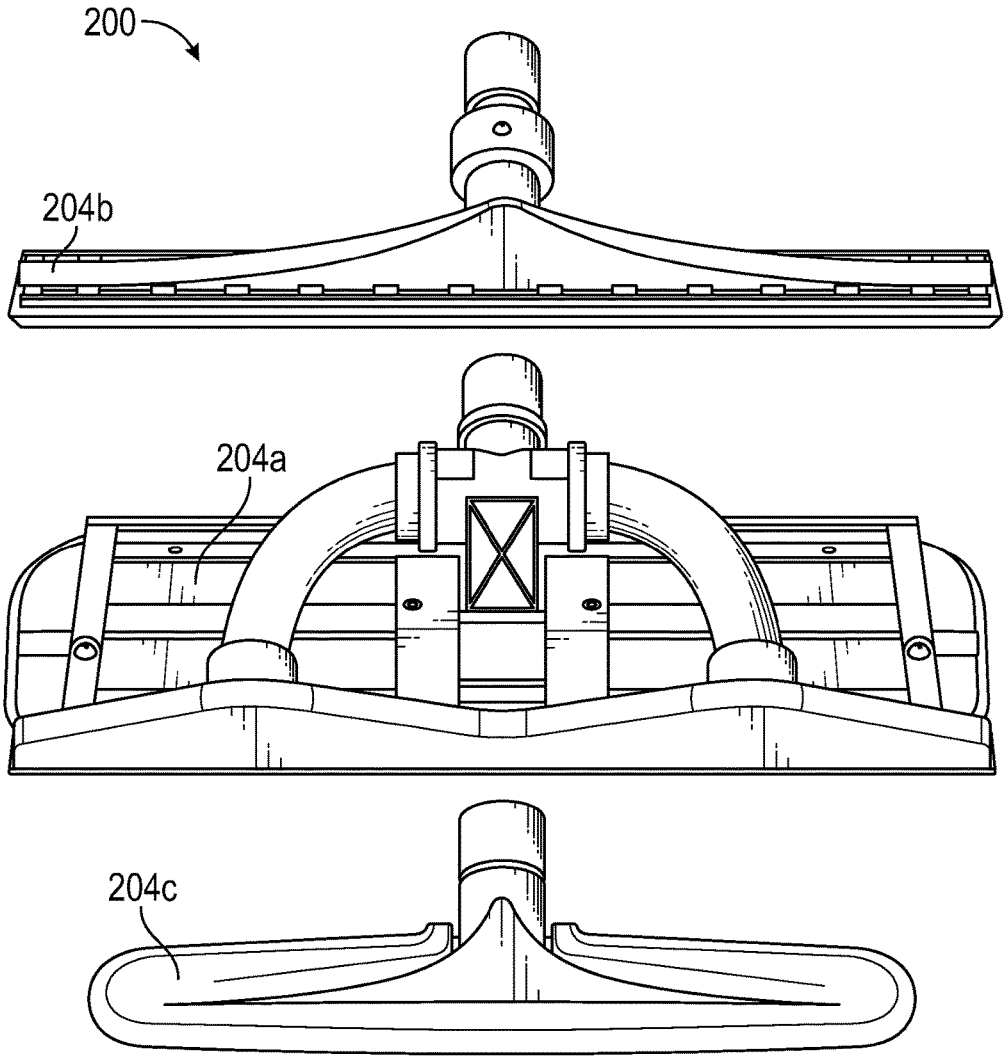
FIG. 9E illustrates various embodiments of the accessory illustrated in FIG. 9A.
Figure 10A:
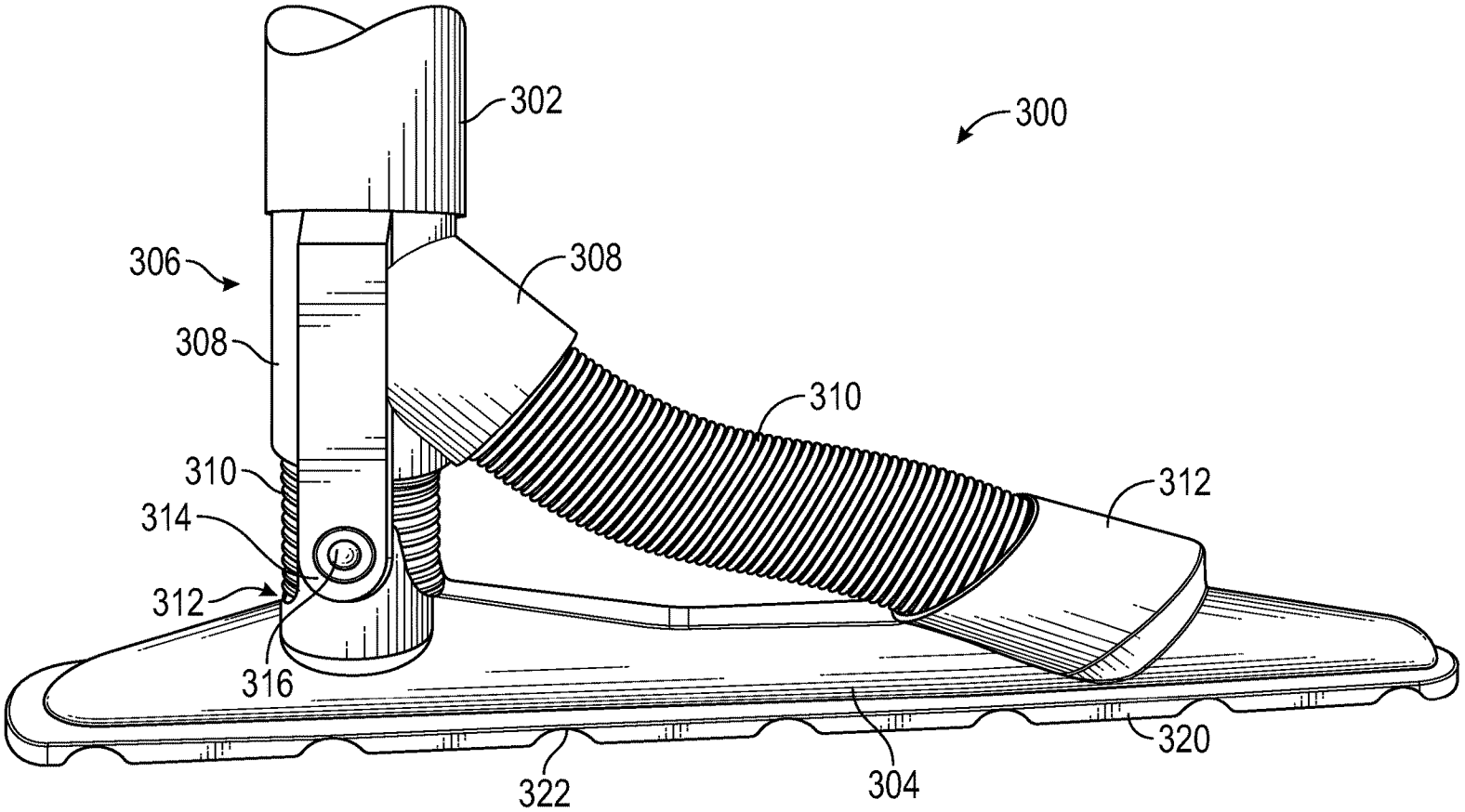
FIG. 10A illustrates a side view of an alternative embodiment of a swivel assembly to that shown in FIG. 6A in accordance with aspects of the present disclosure.
Figure 10B:
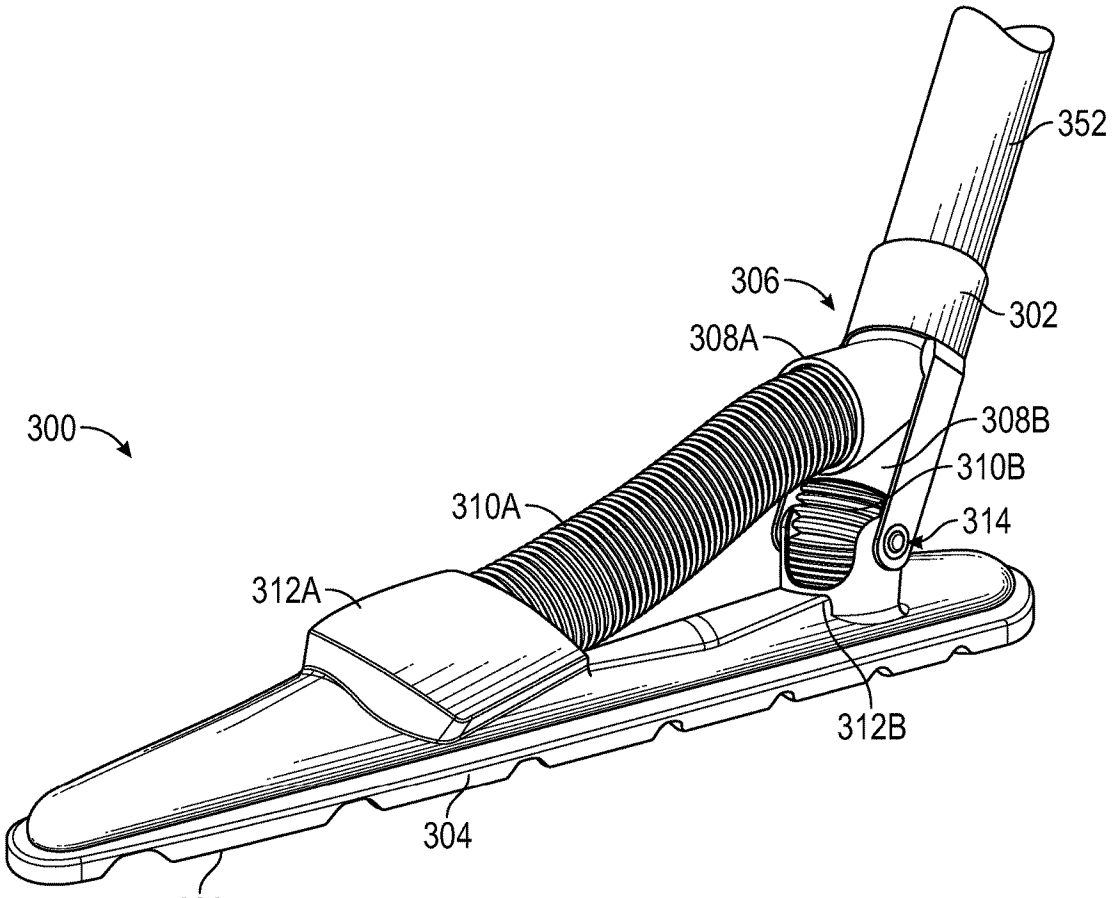
FIG. 10B illustrates a front perspective view of the assembly illustrated in FIG. 10A.
Figure 10C:
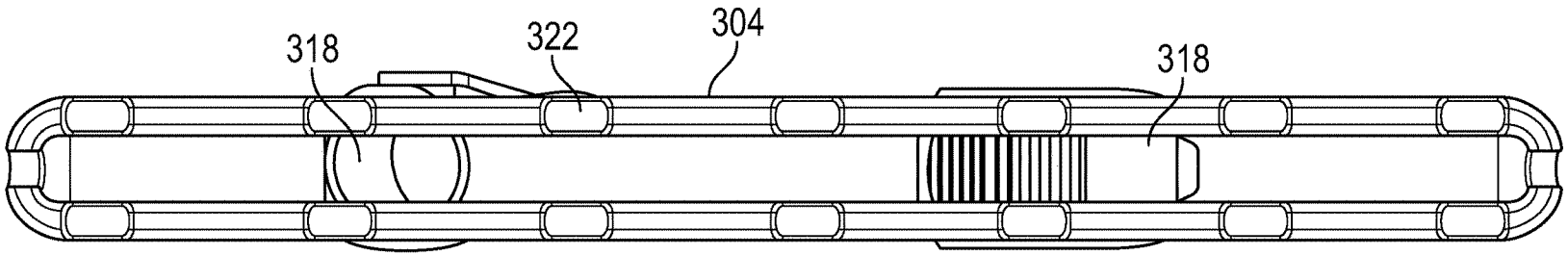
FIG. 10C illustrates a bottom view of the assembly illustrated in FIG. 10A in accordance with certain aspects of the present disclosure.
Figure 11A:
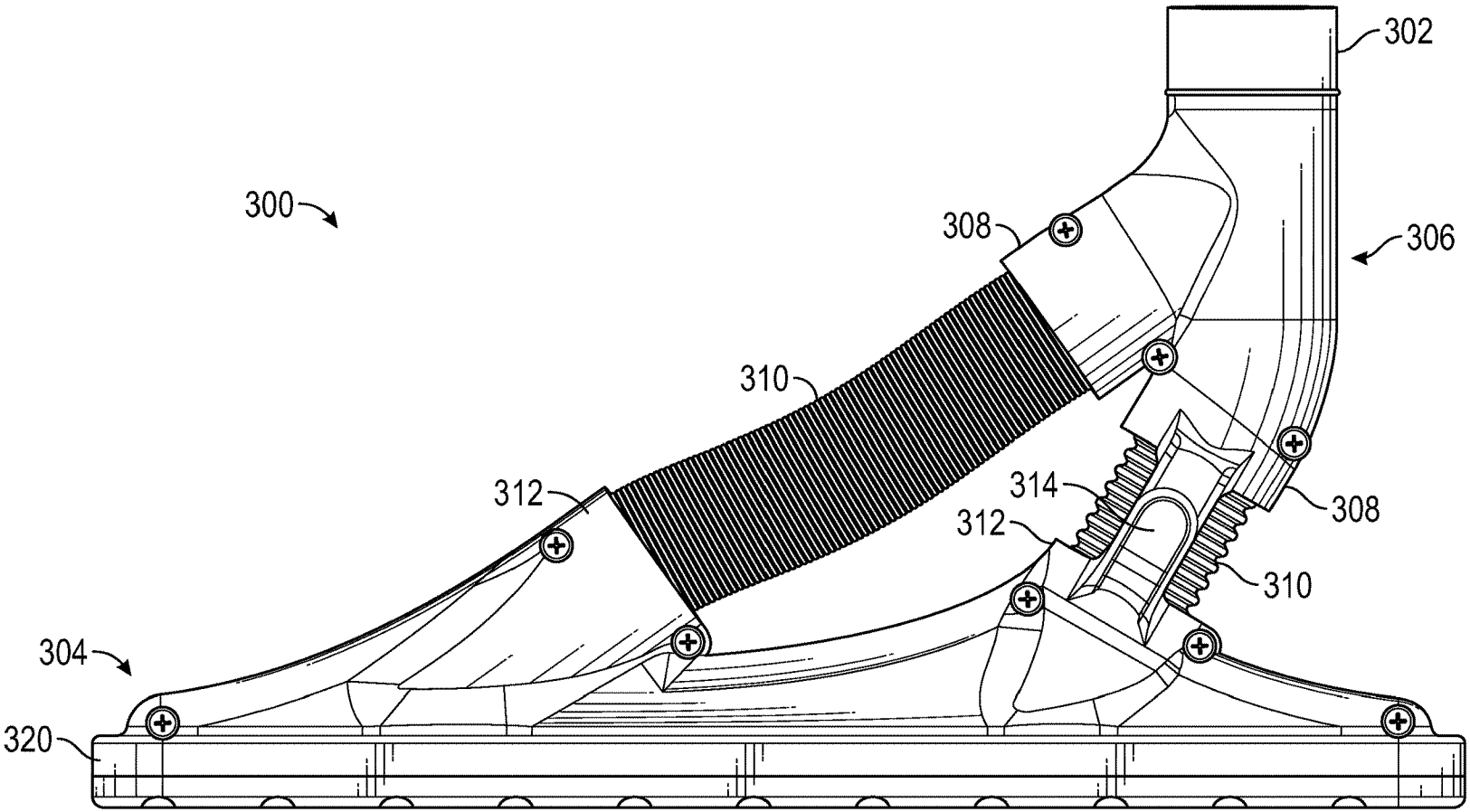
FIG. 11A illustrates a side view of an alternative embodiment of a swivel assembly to that shown in FIG. 10A in accordance with aspects of the present disclosure.
Figure 11B:
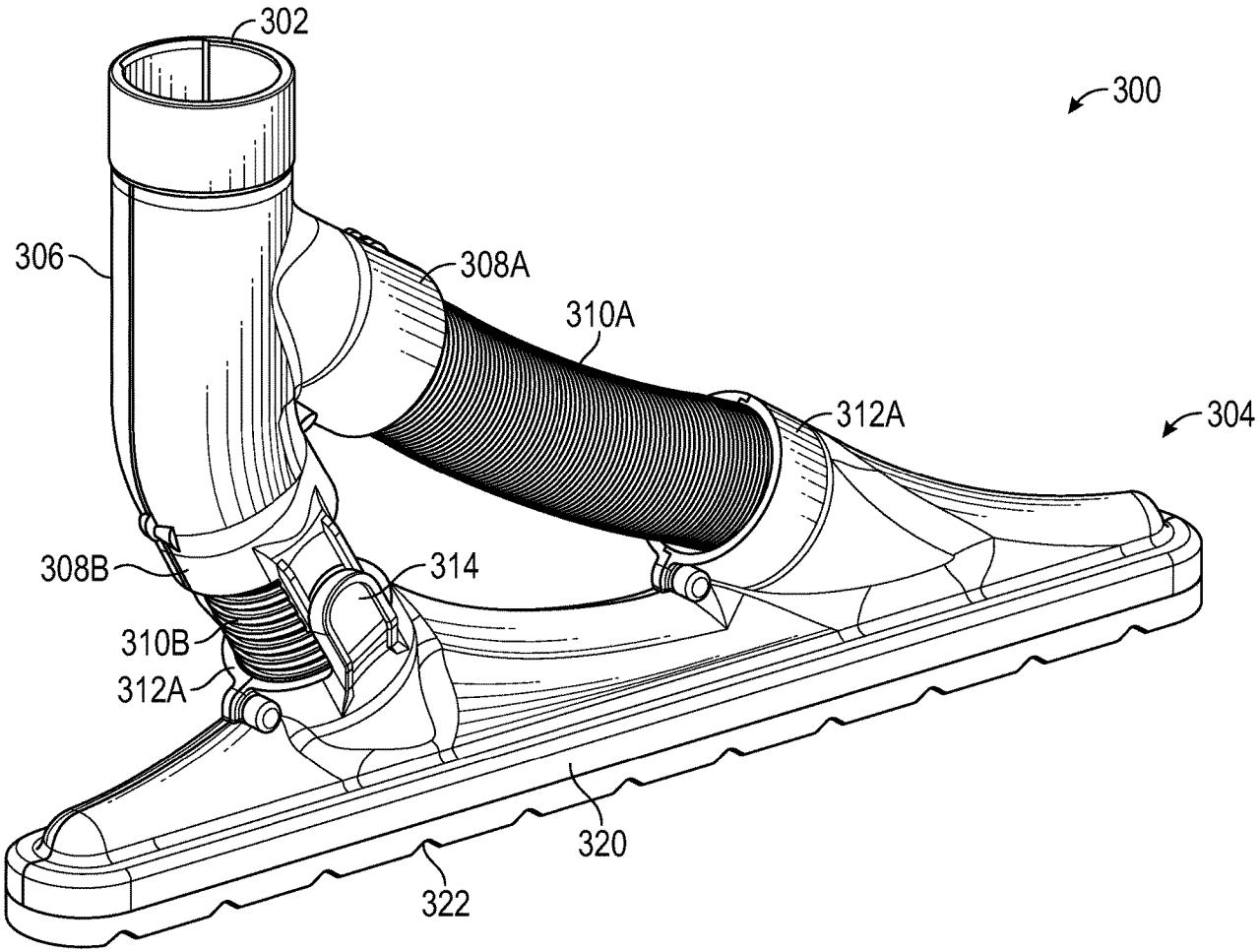
FIG. 11B illustrates a rear perspective view of the assembly illustrated in FIG. 11A.
Figure 11C:
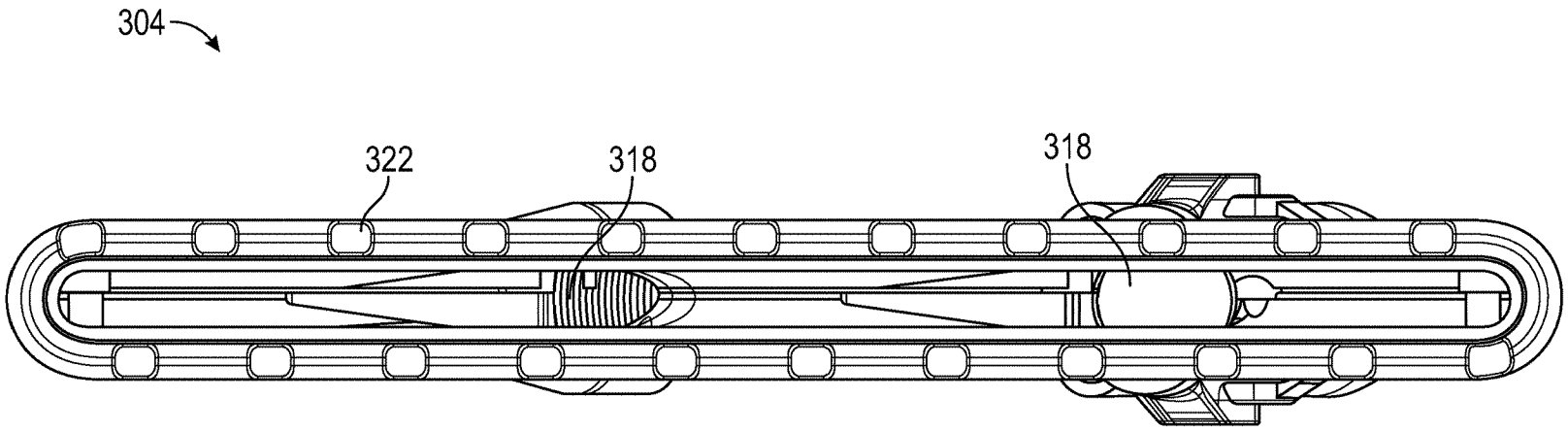
FIG. 11C illustrates a bottom view of the assembly illustrated in FIG. 11A in accordance with certain aspects of the present disclosure.
Figure 12:
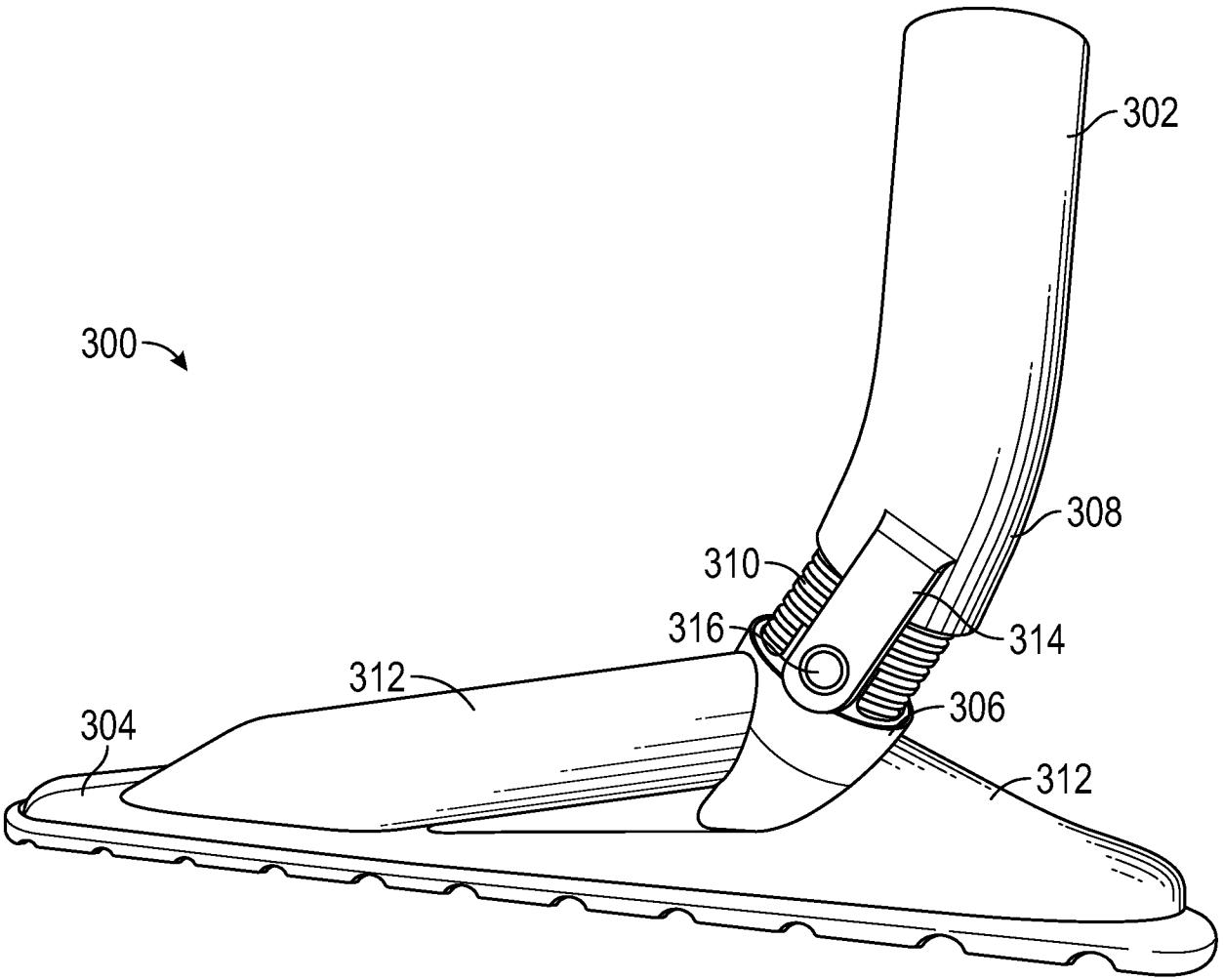
FIG. 12 illustrates a side view of an alternative embodiment of a swivel assembly to that shown in FIG. 10A in accordance with aspects of the present disclosure.

FIG. 9D illustrates bottom view of the assembly illustrated in FIG. 9A in accordance with certain aspects of the present disclosure. FIG. 9E illustrates various embodiments of the accessory illustrated in FIG. 9A. These figures will be described in conjunction with one another. With particular reference to FIG. 9D, mop accessory 216 can include a micro fiber mop or the like for dusting and holding particulates during the surface cleaning. With particular reference to FIG. 9E, accessory 204*a* can include the mop accessory described in greater detail with reference to previous figures (for example, FIGS. 4A and 4B). Accessory 204*b* can include squeegees or the like. Finally, accessory 204*c* can include a brush-based vacuum accessory. Although not explicitly illustrated in this FIG. 10A illustrates a side view of another embodiment of a swivel assembly or system in accordance with certain aspects of the present disclosure. FIG. 10B illustrates a front perspective view of the embodiment of a swivel system illustrated in FIG. 10A. FIG. 10C illustrates a bottom view of the embodiment of a swivel system illustrated in FIG. 10A. FIG. 11A illustrates a side view of another embodiment of a swivel assembly or system in accordance with certain aspects of the present disclosure. FIG. 11B illustrates a rear perspective view of the embodiment of a swivel system illustrated in FIG. 11A. FIG. 11C illustrates a bottom view of the embodiment of a swivel system illustrated in FIG. 11A. FIG. 12 illustrates a side view of another embodiment of a swivel assembly or system in accordance with certain aspects of the present disclosure. These figures will be described in conjunction with one another.

System 300 can include vacuum adapter 302, accessory 304, one or more first air inlets 308, and a plenum chamber 306 adapted to be formed between first air inlets 308*b* within a portion of the adapter 302. The adapter 302 is configured to mate with the vacuum appliance 352 and provide fluid communication between the appliance 352 and the accessory 304. Adapter 302 and accessory 304 can be similarly to adapter 102 and accessory 104, respectively, as described in greater detail above with reference to FIGS. 3-4, or adapter 202 and accessory 204, respectively, as described in greater detail above with reference to FIGS. 6-9. Additionally, system 300 can include one or more first air outlets 312, one or more conduits 310, and a connector 314. Conduits 310 can include any vacuum hose, tube, or the like (i.e., similarly embodied as conduit 110 described above with references to FIGS. 4A and 4B) for commutatively coupling first air inlets 308 to one or more of the first air outlets 312 of accessory 304.

Connector 314 can include any coupler, joint, actuator, or the like that can be adapted to permit the vacuum adapter 302 to pivot about an axis 316 of the vacuum accessory 304. Alternatively, connector 314 can include any coupler, joint, actuator, or the like that can be adapted to permit the vacuum accessory 304 to pivot about an axis 316 of the vacuum adapter 302.

In any case, adapter 302 can pivot relative to the accessory 304 about a lateral axis of the accessory 304 at or near the first or second air inlets 308. More specifically, rather than being located at or near a center of the accessory 304, such as is shown in FIGS. 6-9, the adapter 302 of this embodiment can pivot relative to the accessory 304 about a lateral axis near a first or second end of the accessory 304.

Offsetting the connector 314 away from the center of the accessory 304 makes it intuitive for the user to use a sweeping wiper like motion, as opposed to a back and forth motion as would be expected from a pivot point located near a center of the accessory 304. This sweeping/wiper motion lowers the risk of repetitive motion injuries and increases cleaning productivity.

In one example, swivel system 300 include a first conduit 310*a* coupled between first air outlet 312*a* and first air inlet 308*a*. Similarly, a second conduit 310*b* can be coupled between second air outlet 312*b* and second air inlet 308*b*. With the first and second air inlets (308*a*, 308*b*, respectively) of the adapter 302, the plenum camber 306 can be formed between the two inlets to balance airflow within the adapter 302. In this example, debris received by the vacuum adapter 302 is adapted to flow through the vacuum inlets 318 to at least two vacuum hoses or conduits, such as first and second conduits (310*a* and 310*b*, respectively).

By using multiple air ports 312, and spacing them along a longitudinal axis of the accessory 304, in connection with the plenum chamber 306, even airflow distribution can be achieved, providing improved debris pickup. Precise locations and orientations for the port 312 can be modified for specific air flow distribution. For example, as shown in FIG. 10B, port 312*b* is angled with respect to the accessory 304 at approximately ninety degrees and port 312*a* is angled with respect to the accessory 304 at approximately thirty degrees. Alternatively, one or both of the ports 312 may be angled. For example, as shown in FIG. 11B, both ports 312*a*,312*b* are angled with respect to the accessory 304. For example, one or both of the ports 312*a*, 312*b* could be angled with respect to the accessory 304 at approximately thirty degrees. One or both of the ports 312*a*,312*b* could be angled with respect to the accessory 304 at approximately forty-five degrees. One or both of the ports 312*a*,312*b* could be angled with respect to the accessory 304 at approximately sixty degrees. Alternatively, either (or both) of the ports 312*a*,312*b* could be angled with respect to the accessory 304 between about twenty degrees and ninety degrees. As shown, the angles of the 312*a*,312*b* can be the same as each other, or different from each other.

Figure 11D:
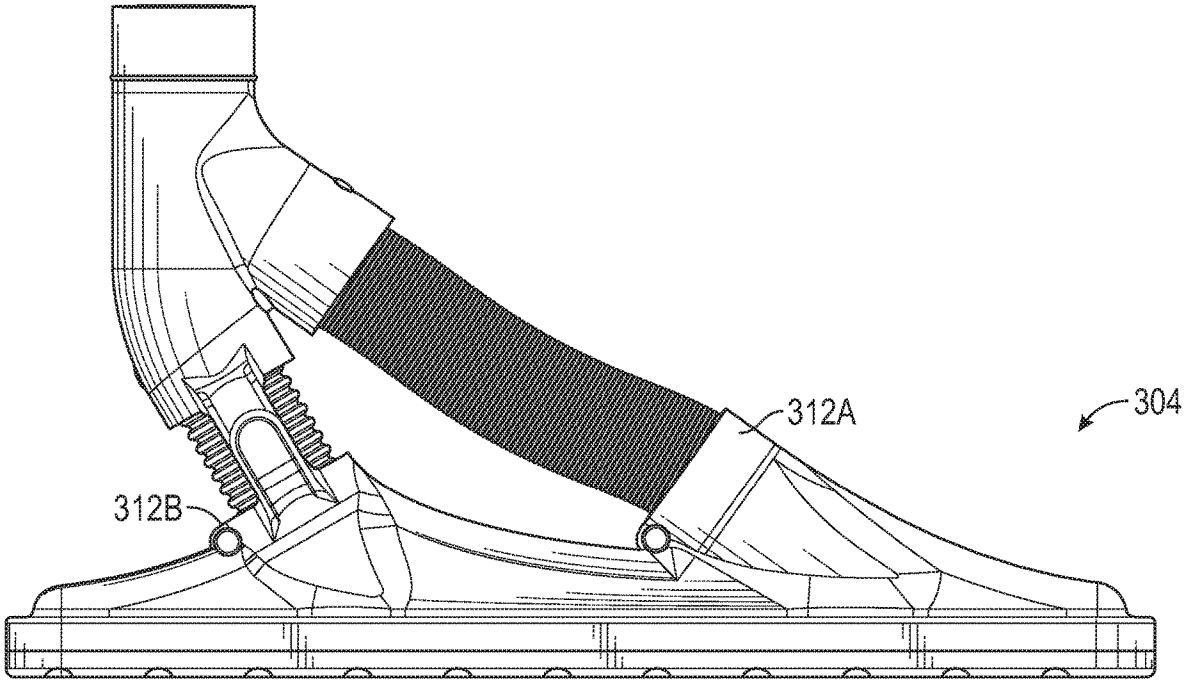
FIG. 11D illustrates a side view of a particular embodiment of the assembly illustrated in FIG. 11A in accordance with certain aspects of the present disclosure.
Figure 11E:
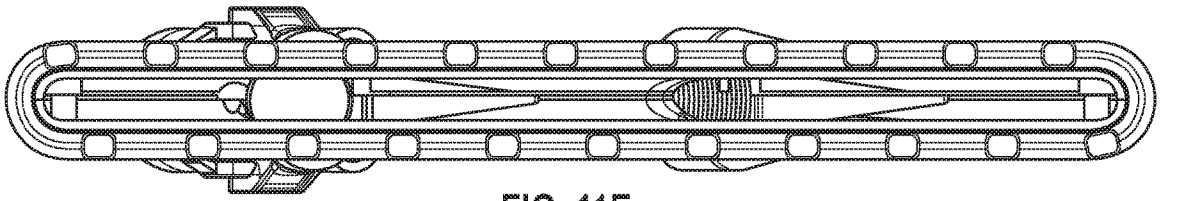
FIG. 11E illustrates a bottom view of a particular embodiment of the assembly illustrated in FIG. 11A in accordance with certain aspects of the present disclosure.
Figure 11F:
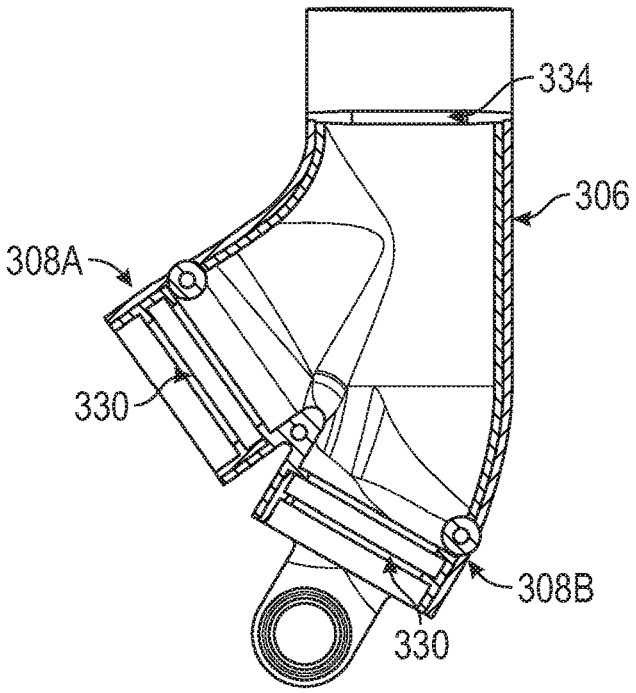
FIGS. 11F-11J illustrate a particular embodiment of the plenum chamber illustrated in FIG. 11A in accordance with certain aspects of the present disclosure.
Figure 11G:
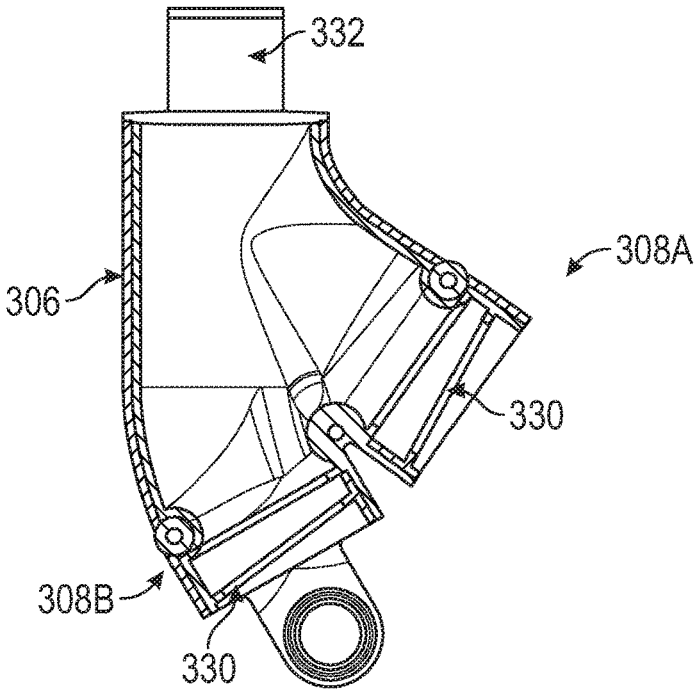
Figure 11J:
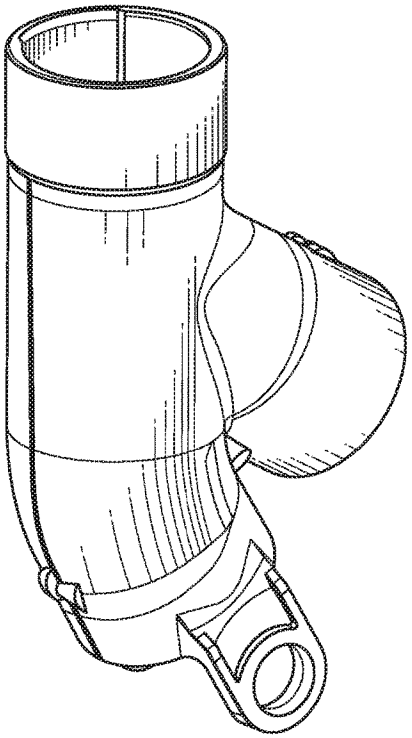
Figure 11I:
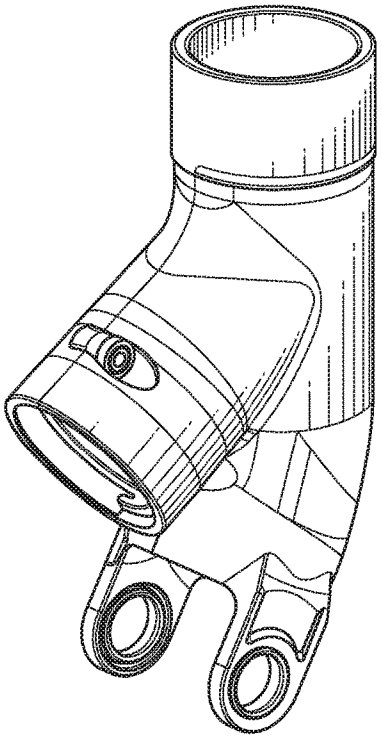
Figure 11H:
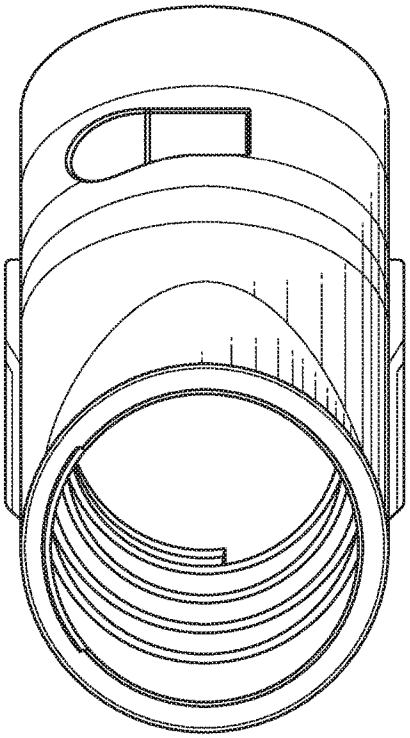

Through research and development, optimum locations and orientations for the ports 312 have been determined for maximum airflow distribution. Specifically, referring to the embodiment shown in FIG. 11D, maximum airflow distribution has been achieved with port 312*a* angled at 30 degrees and port 312*b* angled at 60 degrees, with respect to the longitudinal axis of the accessory 304. With the embodiment shown in FIGS. 11D and 11E being 13.4 inches long, maximum airflow distribution has been achieved with port 312*a* centered at 4.8 inches from its closest end and port 312*b* centered at 3.3 inches from its closest end. In other words, with the embodiment shown in FIGS. 11D and 11E being 13.4 inches long, maximum airflow distribution has been achieved with port 312*a* about 4.8 inches from the center and port 312*b* about 3.4 inches from the center of the accessory 304. Of course, with a longer or shorter accessory, different locations may be used. It can be seen that the port 312*a* with the greater angle is located closer to its closest end, than the other port. In this case, the port 312*a* with the greater angle is located approximately one quarter of the length of the accessory 304 as compared to approximately one third of the length of the accessory 304 for the lower angled port 312*b*.

Of course, near optimum locations and orientations for the ports 312 can be used to achieve adequate airflow distribution. For example, port 312*b* may be angled between 45 degrees and 75 degrees, with respect to the longitudinal axis of the accessory 304. Port 312*a* may be angled between 15 degrees and 45 degrees, with respect to the longitudinal axis of the accessory 304. These angles may be related to the length of the accessory 304. For example, higher angles for the ports 312 may be useful, and more optimal, with a shorter accessory 304. Conversely, lower angles for the ports 312 may be useful, and more optimal, with a longer accessory 304.

Because the ports 312 are angled, it is worthwhile to note how the above "locations" are determined. In the examples given in the preceding paragraphs, the locations are taken at a center of where the ports 312 meet the conduits 310, referenced to the longitudinal axis of the accessory 304.

Another way to determine the locations of the ports 312 would be with reference to the respective vacuum inlet 318, shown in FIG. 11C, for example. Specifically, for maximum airflow distribution, the vacuum inlet 318 associated with the higher angled port 312*a* may span a point that is one quarter the length of the accessory 304, from the closest end. Likewise, for maximum airflow distribution, the vacuum inlet 318 associated with the lower angled port 312*b* may span a point that is one third the length of the accessory 304, from the closest end.

As shown in FIG. 11B, conduit 310*a* may be installed in its fully relaxed state to allow for its greatest range of motion thereby assisting in reaching confined spaces. As an angle between the accessory 304 and the vacuum appliance 352 increases, the first conduit 310*a* extends. Conduit 310*b* may be installed in a partially extended state, due to its proximity to the center of rotation of the connector 314, thereby allowing full articulation of the connector 314, which may not be possible if the conduit 310*b* were installed fully extended or fully relaxed.

As shown in FIG. 11B and FIG. 11C, both ports 312 are angled in the same direction, toward a first end of the accessory 304, closest to the highest angled port 312*b*, and away from a second end of the accessory 304, closest to the lowest angled port 312*a*. Further, as can be seen in FIG. 11B and FIG. 11C, the ports 312 are angled differently. However, as shown in FIG. 12, this is not necessarily true. The ports may be angled in opposite directions and/or with similar or the same angles.

FIGS. 11F-11J illustrate a particular embodiment of the plenum chamber 306. As shown the plenum chamber may include angled internal ribs 330 within the air inlets 308 to secure the conduits 310 therein. Similar ribs 330 may also be included within the air ports 312 to serve the same function. The adapter 302 of the plenum chamber 306 also may comprise a friction fit end ring.

In at least some embodiments, such as shown in FIGS. 11F-11J, the plenum chamber 306 may be constructed from two half shells. One half shell may include one or more interlocking tabs 332 that fits within one or more cutouts 334 in the other half shell, in order to align and/or secure the half shells together to form the plenum chamber 306. The use of such interlocking tabs 332 may allow the assembly of the plenum chamber 306 to remain together without the use of fasteners and/or may help control an inner diameter of the adapter 302 to ensure a good friction fit to the vacuum appliance 352.

The plenum chamber 306 may be sized and configured to fully pivot back at the connector 314, such that the accessory 304, and plenum chamber 306 may fit under a low obstruction, such as a dresser or other furniture. In at least one embodiment, the accessory 304, and plenum chamber 306 may fit under a six inch obstruction.

Similarly, the forward port 312*a* and flexibility of the conduit 310*a* may be such that a majority of the accessory 304 may fit under even a lower obstruction. For example, in at least one embodiment, a majority of the accessory 304 including the foraward port 312*a* up to the rearward port 312*b* may fit under a four inch obstruction.

Figure 11K:
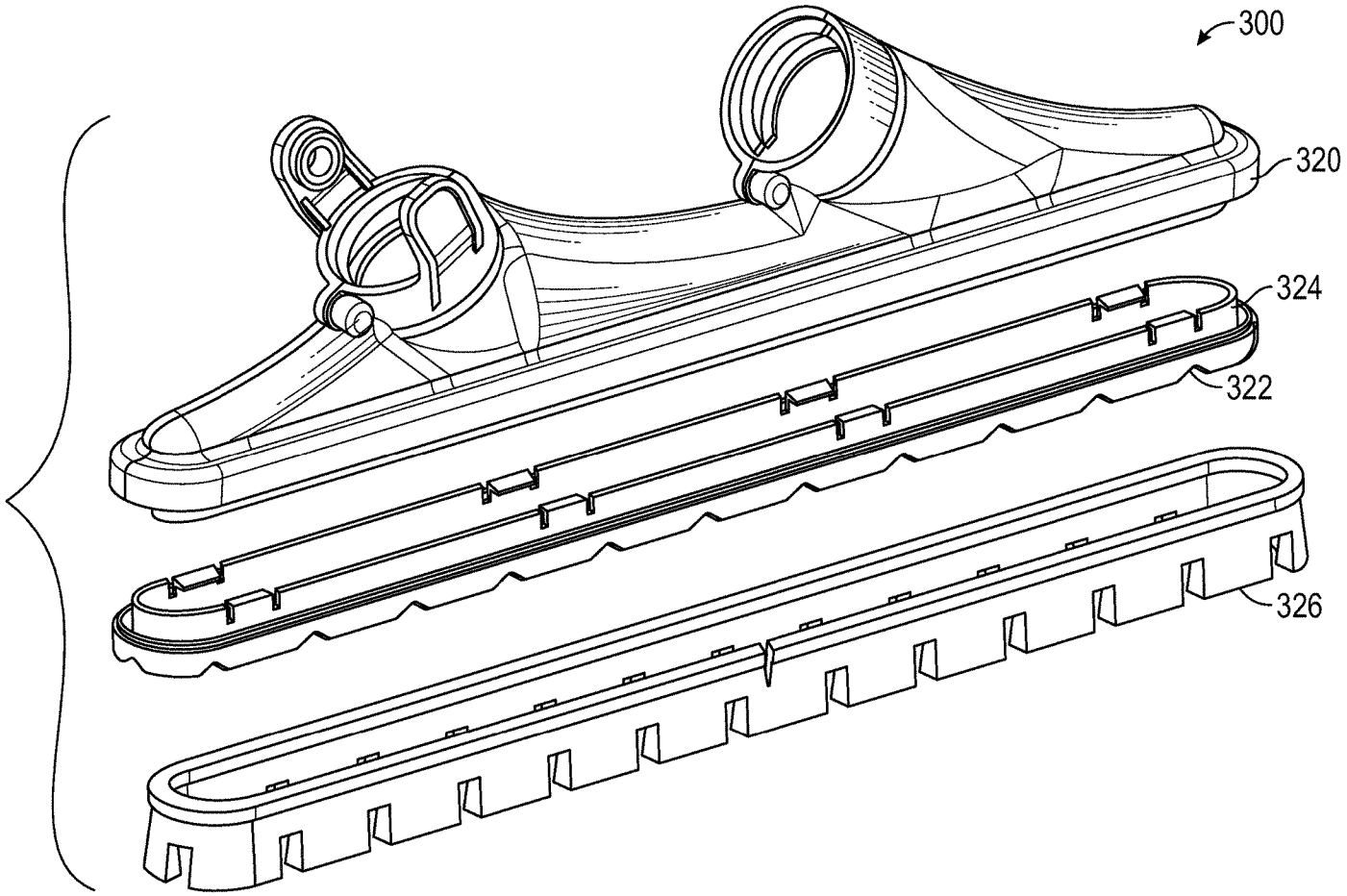
FIG. 11K illustrates an exploded view of portions of the assembly illustrated in FIG. 11A in accordance with certain aspects of the present disclosure.
Figure 11L:
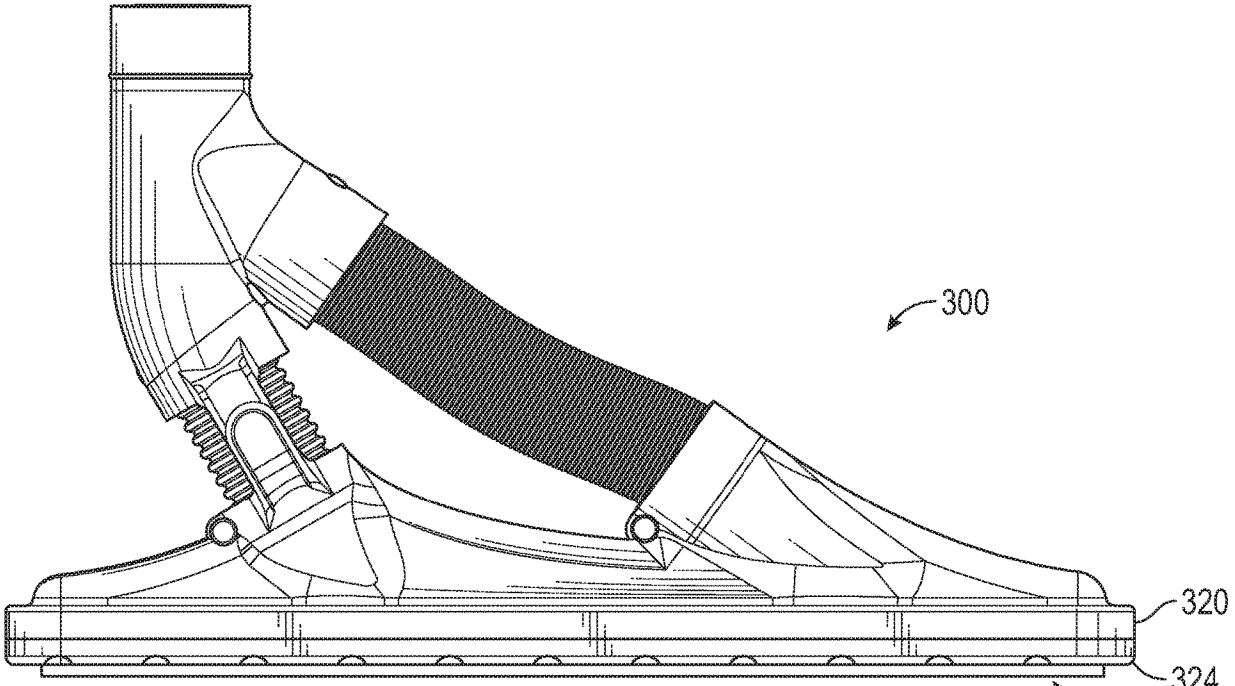
FIG. 11L illustrates a side view of a particular embodiment of the assembly illustrated in FIG. 11A in accordance with certain aspects of the present disclosure.
Figure 11M:
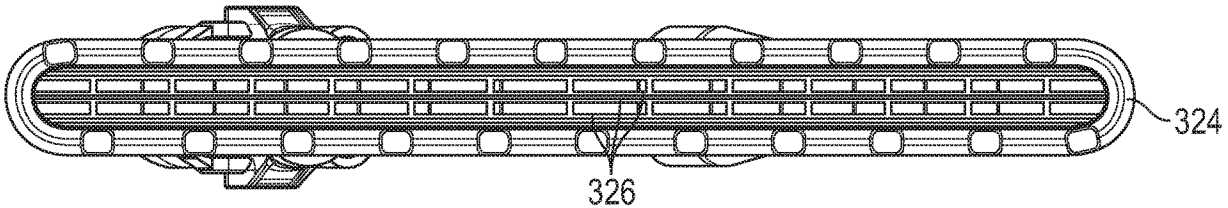
FIG. 11M illustrates a bottom view of a particular embodiment of the assembly illustrated in FIG. 11A in accordance with certain aspects of the present disclosure.
Figure 11N:
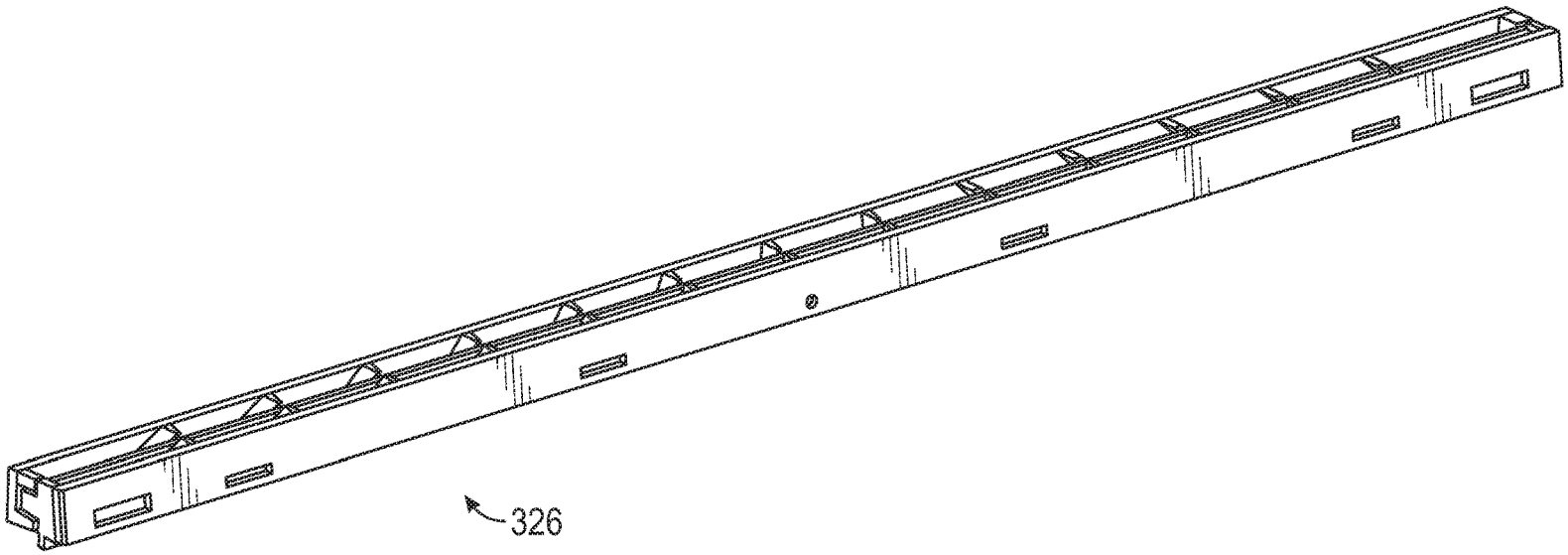
FIG. 11N illustrates a side view of a particular embodiment of a flexible insert for use with the assembly illustrated in FIG. 11A in accordance with certain aspects of the present disclosure.

As shown in FIG. 11K, the accessory 304 may be configured for hard surfaces, soft surfaces, wet surface, and/or dry surfaces. For example, a bottom edge 320 of the accessory 304 may be rigid with or without airflow cutouts 322, as shown. Alternatively, the bottom edge 320 of the accessory 304 may receive a rigid insert 324 with or without the airflow cutouts 322. As still another alternative, the bottom edge 320 of the accessory 304 may receive a flexible insert 326, such as a squeegee for dealing with wet surfaces or a brush designed to dislodge debris from carpeted or hard surfaces. The flexible insert 326, in the form of a squeegee, could include one or more blades, each with or without airflow cutouts 322. Likewise, the flexible insert 326, in the form of a brush, could include one or more rows of bristles, each row with or without airflow cutouts 322. The rigid insert 324 and/or the flexible insert 326 may be interchangeably received by the bottom edge 320. Alternatively, as best seen in FIGS. 11L-11N, the rigid insert 324 may be designed to selectively receive the flexible insert 326.

As shown in FIG. 12, the plenum chamber 306 can be relocated below the conduit 310, thus requiring only one conduit 310 to service multiple vacuum inlets 318 and air outlets 312. For example, as shown, the air outlets 312 may connect directly to the plenum chamber 306 without an intervening conduit 310. The conduit 310 may connect the plenum chamber 306 to the air inlet 308, which then connects directly to the adapter 302.

The term "approximately," as used throughout the disclosure to describe a distance, can be defined as an distance that deviates no more than +/−10% of the nominal value. For example (referring to FIG. 8), if the accessory width 204W is 16 inches, and the width 204WA is approximately half the width of 204WB, 201A can range between 3.6-4.4 inches (i.e., nominal value equally 4 inches). Furthermore, an "approximate" distance can equal the distance angle as well such that, for the example above, 204WA can equal 4.0 inches and still be approximately half the distance 204WB.

The term "coupled," "coupling," "coupler," and like terms are used broadly herein and can include any method or device for securing, binding, bonding, fastening, attaching, joining, inserting therein, forming thereon or therein, or otherwise associating, for example, mechanically, magnetically, electrically, chemically, operably, directly or indirectly with intermediate elements, one or more pieces of members together and can further include without limitation integrally forming one functional member with another in a unitary fashion. The coupling can occur in any direction, including rotationally.

Particular embodiments of the invention may be described with reference to block diagrams and/or operational illustrations of methods. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Other and further embodiments utilizing one or more aspects of the inventions described above can be devised without departing from the spirit of Applicant's invention. It should be appreciated by those of skill in the art that the techniques disclosed in the disclosed embodiments represent techniques discovered by the inventor(s) to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

In some alternate implementations, the functions/actions/structures noted in the figures can occur out of the order noted in the block diagrams and/or operational illustrations. For example, two operations shown as occurring in succession, in fact, can be executed substantially concurrently or the operations can be executed in the reverse order, depending upon the functionality/acts/structure involved. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range of equivalent of the following claims.

What is claimed is:

1. A vacuum accessory having an elongated axis, the accessory comprising:

an elongated bottom edge oriented along the elongated axis of the accessory; and at least first and second air outlet ports located and angled along the elongated axis of the accessory to balance airflow along the elongated axis of the accessory, wherein the first air outlet port is one of oriented perpendicular to the elongated axis of the accessory and angled toward a first end of the accessory at between forty-five and ninety degrees, and the second air outlet port is angled toward the first end of the accessory at between fifteen and forty-five degrees.

2. The accessory according to claim 1, wherein the first port is angled between forty-five and seventy-five degrees to the elongated axis of the accessory.

3. The accessory according to claim 1, wherein the first port is located closer to the first end of the accessory and angled toward the first end of the accessory at between forty-five and seventy-five degrees to the elongated axis of the accessory.

4. The accessory according to claim 1, wherein the first port is angled sixty degrees to the elongated axis of the accessory.

5. The accessory according to claim 1, wherein the first port is located closer to the first end of the accessory and angled toward the first end of the accessory at sixty degrees to the elongated axis of the accessory.

6. The accessory according to claim 1, wherein the second port is located closer to a second end of the accessory.

7. The accessory according to claim 1, wherein the second port is angled thirty degrees to the elongated axis of the accessory.

8. The accessory according to claim 1, wherein the second port is located closer to a second end of the accessory and angled toward the first end of the accessory at thirty degrees to the elongated axis of the accessory.

9. The accessory according to claim 1, wherein the first port is located closer to the first end of the accessory and angled toward the first end of the accessory at between forty-five and seventy-five degrees to the elongated axis of the accessory, and the second port is located closer to a second end of the accessory.

10. The accessory according to claim 1, wherein the ports are spaced along the elongated axis of the accessory to balance airflow along the elongated axis of the accessory.

11. The accessory according to claim 10, wherein the first port is centered along the elongated axis of the accessory at a point one quarter of the elongated axis of the accessory from a closest end of the accessory.

12. The accessory according to claim 10, wherein the second port is centered along the elongated axis of the accessory at a point one third of the elongated axis of the accessory from a closest end of the accessory.

13. The accessory according to claim 10, wherein the first port is centered along the elongated axis of the accessory at a point between one fifth and one third of the elongated axis of the accessory from a closest end of the accessory.

14. The accessory according to claim 10, wherein the second port is centered along the elongated axis of the accessory at a point between one half and one quarter of the elongated axis of the accessory from a closest end of the accessory.

15. The accessory according to claim 10, wherein the first port is centered along the elongated axis of the accessory at a point one quarter of the elongated axis of the accessory and the second port is centered along the elongated axis of the accessory at a point two thirds of the elongated axis of the accessory, measured from the first end of the elongated axis of the accessory.

16. The accessory according to claim 1, wherein the bottom edge is rigid with airflow cutouts along its length.

17. The accessory according to claim 1, wherein the bottom edge receives a rigid insert with airflow cutouts along its length.

18. The accessory according to claim 1 wherein the bottom edge receives a flexible insert.

19. The accessory according to claim 1 wherein the bottom edge receives a brush.

20. The accessory according to claim 1, wherein the ports are angled differently, such that a first angle of the first air outlet port is different than a second angle of the second air outlet port.

21. The accessory according to claim 1, wherein a first angle of the first air outlet port is the same as a second angle of the second air outlet port.

22. A vacuum accessory having an elongated axis, the accessory comprising:

an elongated bottom edge oriented along the elongated axis of the accessory;

at least first and second air outlet ports located and angled along the elongated axis of the accessory to balance airflow along the elongated axis of the accessory;

a plenum chamber having an adapter for connection to a vacuum appliance;

a first flexible and extendable conduit connecting the first air outlet port to the plenum chamber; and a second flexible and extendable conduit connecting the second air outlet port to the plenum chamber, wherein the second conduit is partially extended and the first conduit extends as an angle between the accessory and the vacuum appliance is increased.

23. A vacuum accessory having an elongated axis, the accessory comprising:

an elongated bottom edge oriented along the elongated axis of the accessory; and at least first and second air outlet ports spaced along the elongated axis of the accessory, wherein the first outlet port is centered along the elongated axis of the accessory at a point one quarter of the elongated axis of the accessory, measured from a first end of the accessory, and is angled toward the first end of the accessory at between forty-five and seventy-five degrees, and wherein the second outlet port is centered along the elongated axis of the accessory at a point two thirds of the elongated axis of the accessory, measured from the first end of the accessory, and is angled toward the first end of the accessory at between fifteen and forty-five degrees.

* * * * *